US009750309B2

(12) United States Patent
Xanthos

(10) Patent No.: US 9,750,309 B2
(45) Date of Patent: Sep. 5, 2017

(54) ARTICLES OF FOOTWEAR WITH AN ALTERNATE FASTENING SYSTEM

(71) Applicant: NIKE, Inc., Beaverton, OR (US)

(72) Inventor: George A. Xanthos, Beaverton, OR (US)

(73) Assignee: NIKE, Inc., Beaverton, OR (US)

( * ) Notice: Subject to any disclaimer, the term of this patent is extended or adjusted under 35 U.S.C. 154(b) by 10 days.

(21) Appl. No.: 15/049,708

(22) Filed: Feb. 22, 2016

(65) Prior Publication Data

US 2017/0196312 A1 Jul. 13, 2017

Related U.S. Application Data

(63) Continuation-in-part of application No. 14/991,325, filed on Jan. 8, 2016.

(51) Int. Cl.

| | |
|---|---|
| ***A43C 1/00*** | (2006.01) |
| ***A43C 11/16*** | (2006.01) |
| ***A43B 13/22*** | (2006.01) |
| ***A43B 23/02*** | (2006.01) |
| ***A43C 5/00*** | (2006.01) |

(52) U.S. Cl.

CPC ..... *A43C 11/16* (2013.01); *A43B 13/22* (2013.01); *A43B 23/028* (2013.01); *A43C 1/00* (2013.01); *A43C 5/00* (2013.01); *A43C 11/165* (2013.01)

(58) Field of Classification Search

CPC ..... A43C 1/00; A43C 11/00; A43C 11/165; A43B 7/1495

USPC ..... 36/50.1, 91

See application file for complete search history.

(56) References Cited

U.S. PATENT DOCUMENTS

| | | | | | |
|---|---|---|---|---|---|
| 75,702 | A | * | 3/1868 | Rice | F16G 11/12 24/575.1 |
| 871,528 | A | | 11/1907 | Senn | |
| 1,088,067 | A | * | 2/1914 | Forbes | A43C 1/00 24/69 SK |
| 1,497,568 | A | | 6/1924 | Kelley | |
| 2,012,188 | A | | 8/1935 | Horace | |
| 3,200,458 | A | | 8/1965 | Marzocchi | |
| 4,081,916 | A | | 4/1978 | Salisbury | |
| 4,282,657 | A | * | 8/1981 | Antonious | A43B 5/00 24/306 |
| 4,414,761 | A | | 11/1983 | Mahood | |

(Continued)

FOREIGN PATENT DOCUMENTS

| | | | |
|---|---|---|---|
| DE | 102007032568 | A1 | 2/2009 |
| DE | 102008006135 | A1 | 7/2009 |

(Continued)

OTHER PUBLICATIONS

International Search Report and Written Opinion mailed in corresponding PCT/US2016/012683 on Jun. 27, 2016.

*Primary Examiner* — Marie Bays
(74) *Attorney, Agent, or Firm* — Wissing Miller LLP

(57) ABSTRACT

An article of footwear has an upper with tensioning components. The upper includes a fastening system with a tensioning device. The tensioning device may be utilized with a plurality of cables. The tensioning device is removably attached to the upper by a clasp element to facilitate entry of a foot into the article of footwear, or exit of a foot from the article of footwear. The tensioning device can allow the lengths of the cables to readily change in order to accommodate different foot shapes.

18 Claims, 14 Drawing Sheets

(56) References Cited

U.S. PATENT DOCUMENTS

| | | | | |
|---|---|---|---|---|
| 4,592,154 | A * | 6/1986 | Oatman | A43B 5/00 36/114 |
| 4,628,622 | A | 12/1986 | McBarron | |
| 4,860,464 | A * | 8/1989 | Misevich | A43B 7/1495 36/114 |
| 5,027,482 | A | 7/1991 | Torppey | |
| 5,353,483 | A | 10/1994 | Louviere | |
| 5,357,691 | A | 10/1994 | Hyde et al. | |
| 5,537,763 | A * | 7/1996 | Donnadieu | A43C 1/00 36/50.1 |
| 5,659,982 | A * | 8/1997 | Muraoka | A43B 3/0073 36/131 |
| 5,687,460 | A | 11/1997 | Foffano et al. | |
| 5,907,912 | A | 6/1999 | Alaimo | |
| 6,416,074 | B1 | 7/2002 | Maravetz et al. | |
| 6,671,980 | B1 * | 1/2004 | Liu | A43B 11/00 24/712 |
| 6,757,991 | B2 * | 7/2004 | Sussmann | A43C 11/008 36/50.1 |
| 6,763,614 | B2 | 7/2004 | Smith | |
| 6,941,683 | B2 | 9/2005 | Freed | |
| 6,945,543 | B2 | 9/2005 | De Bortoli et al. | |
| 7,574,818 | B2 | 8/2009 | Meschter | |
| 7,765,721 | B2 | 8/2010 | Hentz, III et al. | |
| 7,889,036 | B2 | 2/2011 | Fiedler | |
| 7,975,403 | B2 | 7/2011 | Mosher | |
| 8,009,002 | B2 | 8/2011 | Fiedler | |
| 8,266,827 | B2 | 9/2012 | Dojan et al. | |
| 8,353,544 | B2 | 1/2013 | Fiedler | |
| 8,359,716 | B2 | 1/2013 | Fiedler | |
| 8,368,494 | B2 | 2/2013 | Fiedler | |
| 8,430,434 | B2 | 4/2013 | Fiedler | |
| 8,464,403 | B2 | 6/2013 | Fiedler | |
| 8,484,809 | B2 | 7/2013 | Fiedler | |
| 8,495,803 | B2 | 7/2013 | Fiedler | |
| 8,739,371 | B2 | 6/2014 | Fiedler | |
| 8,794,682 | B2 | 8/2014 | Fiedler | |
| 8,800,117 | B2 | 8/2014 | Fiedler | |
| 8,850,670 | B2 | 10/2014 | Fiedler | |
| 8,851,534 | B2 | 10/2014 | Fiedler | |
| 9,113,674 | B2 | 8/2015 | Dojan | |
| 2003/0051374 | A1 * | 3/2003 | Freed | A43C 1/003 36/50.1 |
| 2009/0100708 | A1 * | 4/2009 | Kelley | A43C 11/1493 36/54 |
| 2012/0216373 | A1 | 8/2012 | Fiedler | |
| 2012/0227220 | A1 | 9/2012 | Fiedler | |
| 2012/0248793 | A1 | 10/2012 | Fiedler | |
| 2012/0291227 | A1 | 11/2012 | Fiedler | |
| 2013/0011179 | A1 | 1/2013 | Fiedler | |
| 2014/0339232 | A1 | 11/2014 | Fiedler | |

FOREIGN PATENT DOCUMENTS

| | | | |
|---|---|---|---|
| DE | 202011052397 | U1 | 1/2012 |
| DE | 102010037912 | A1 | 4/2012 |
| DE | 102010044194 | A1 | 5/2012 |
| DE | 102010044198 | A1 | 5/2012 |
| DE | 102013203440 | A1 | 8/2014 |
| DE | 102013203409 | A1 | 9/2014 |
| DE | 102013203844 | A1 | 9/2014 |
| DE | 102013006969 | | 10/2014 |
| EP | 2671467 | A2 | 12/2013 |
| EP | 2640604 | B1 | 3/2015 |
| GB | 2465973 | | 6/2010 |
| JP | 2001112504 | A | 4/2001 |
| WO | 2005096264 | A1 | 10/2005 |
| WO | 2009071075 | A2 | 6/2009 |
| WO | 2014086874 | A2 | 6/2014 |
| WO | 2014090926 | A1 | 6/2014 |
| WO | 2014180512 | A1 | 11/2014 |
| WO | 2015003904 | A1 | 1/2015 |
| WO | 2015004278 | A1 | 1/2015 |
| WO | 2015028044 | A1 | 3/2015 |

* cited by examiner

ARTICLES OF FOOTWEAR WITH AN ALTERNATE FASTENING SYSTEM

CROSS-REFERENCE TO RELATED APPLICATION(S)

This application is a Continuation-In-Part Application of Xanthos, U.S. Patent Publication Number 20160331084, published on Nov. 17, 2016, titled "Articles of Footwear With An Alternate Fastening System" (now U.S. patent application Ser. No. 14/991,325, and filed on Jan. 8, 2016, the disclosure of which is hereby incorporated by reference in its entirety.

BACKGROUND

The present embodiments relate generally to articles of footwear. Articles of footwear generally include two primary elements: an upper and a sole structure. The upper may be formed from a variety of materials that are stitched or bonded together to form a void within the footwear for comfortably and securely receiving a foot. The sole structure is secured to a lower portion of the upper and is generally positioned between the foot and the ground. In many articles of footwear, including athletic footwear styles, the sole structure often incorporates an insole, a midsole, and an outsole.

In one aspect, the present disclosure is directed to an article of footwear comprising an upper including a forefoot region, a midfoot region, a medial side, and a lateral side, where the upper includes a closed configuration and an open configuration. The upper also comprises a fastening system, where the fastening system includes a tensioning device and a plurality of cables. The tensioning device is releasably secured to a lateral side of the upper by a clasp element. In addition, the plurality of cables include a first cable, where the first cable includes a first end, a second end, a forward portion, a rearward portion, and an intermediate portion. The first end of the first cable is attached to a medial side of the upper in the forefoot region, the second end of the first cable is attached to the medial side of the upper in the midfoot region, and the intermediate portion extends through an interior of the tensioning device. Furthermore, the forward portion of the first cable extends between the first end of the first cable to the tensioning device, where the rearward portion of the first cable extends between the second end of the first cable to the tensioning device.

Other systems, methods, features and advantages of the embodiments will be, or will become, apparent to one of ordinary skill in the art upon examination of the following figures and detailed description. It is intended that all such additional systems, methods, features and advantages be included within this description and this summary, be within the scope of the embodiments, and be protected by the following claims.

BRIEF DESCRIPTION OF THE DRAWINGS

The embodiments can be better understood with reference to the following drawings and description. The components in the figures are not necessarily to scale; emphasis is instead being placed upon illustrating the principles of the embodiments. Moreover, in the figures, like reference numerals designate corresponding parts throughout the different views.

DETAILED DESCRIPTION

Figure 1:
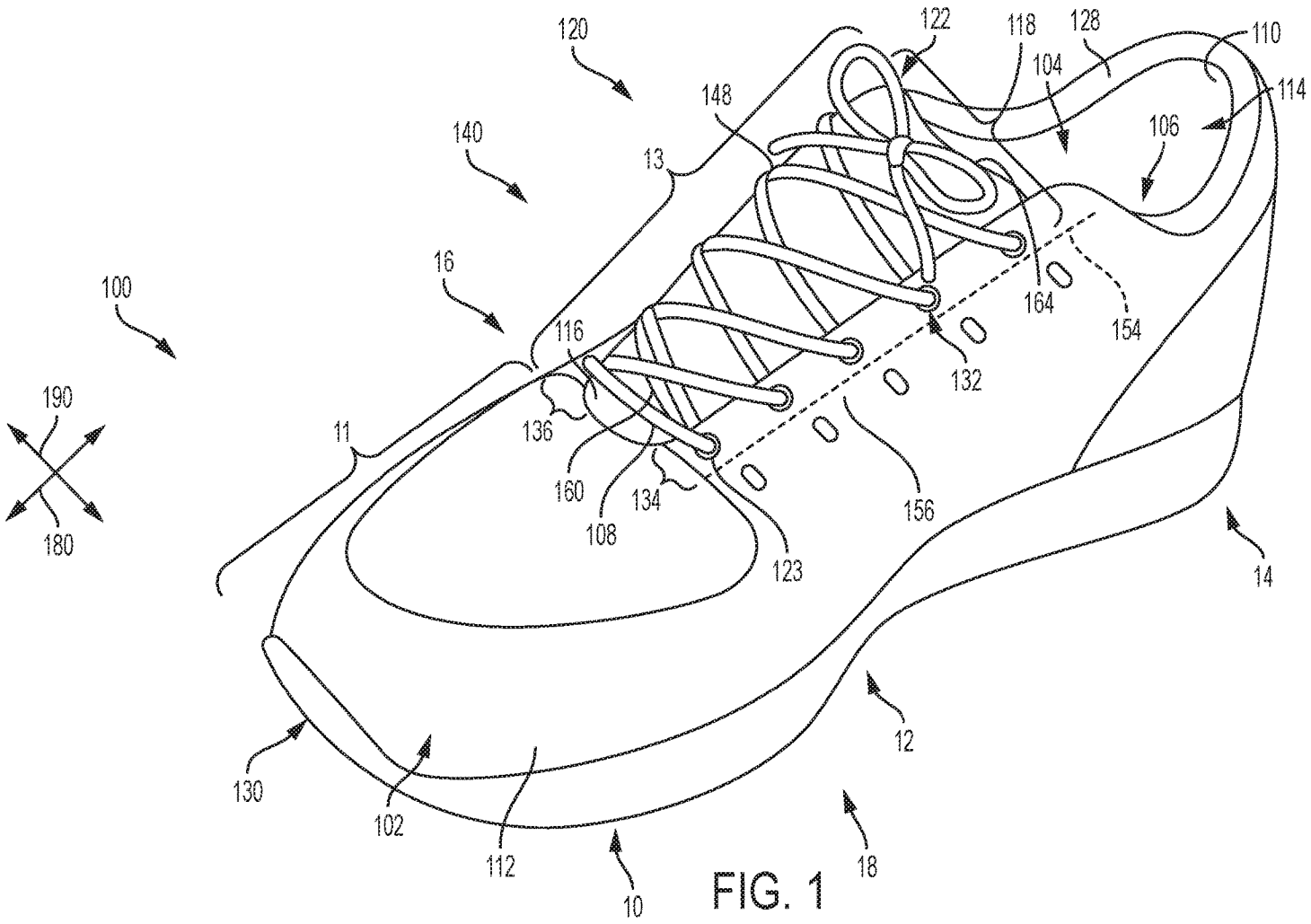
FIG. 1 is a schematic isometric view of an embodiment of an article of footwear including an upper and a sole structure.
Figure 2:
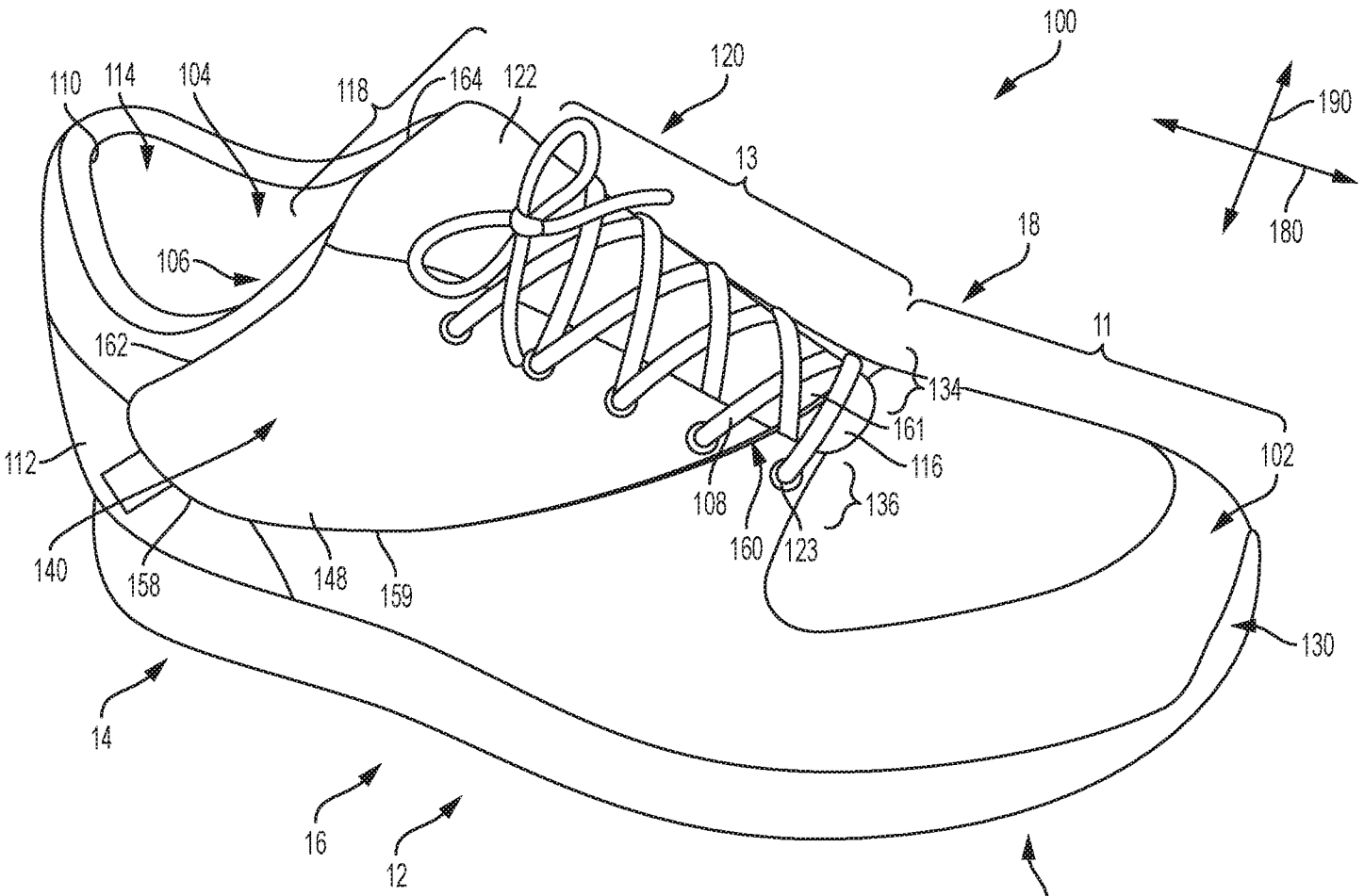
FIG. 2 is a schematic isometric view of an embodiment of an article of footwear including an upper and a sole structure.

FIGS. 1-2 depict isometric views of an embodiment of an article of footwear 100. In one embodiment, article of footwear 100 has the form of an athletic shoe for use by adults or children. In some embodiments, article of footwear 100 could be an athletic shoe. In other embodiments, article of footwear 100 could be any kind of outdoor or indoor shoe.

Furthermore, in other embodiments, the provisions discussed herein for article of footwear 100 could be incorporated into various other kinds of footwear including, but not limited to, basketball shoes, hiking boots, soccer shoes, football shoes, sneakers, running shoes, cross-training shoes, rugby shoes, baseball shoes as well as other kinds of shoes. Moreover, in some embodiments, the provisions discussed herein for article of footwear 100 could be incorporated into various other kinds of non-sports-related footwear, including, but not limited to, slippers, sandals, boots, high-heeled footwear, and loafers.

For purposes of clarity, the following detailed description discusses the features of article of footwear 100, also referred to simply as article 100. However, it will be understood that other embodiments may incorporate a corresponding article of footwear (e.g., a right article of footwear when article 100 is a left article of footwear) that may share some, and possibly all, of the features of article 100 described herein and shown in the figures.

The embodiments may be characterized by various directional adjectives and reference portions. These directions and reference portions may facilitate in describing the portions of an article of footwear. Moreover, these directions and reference portions may also be used in describing subcomponents of an article of footwear (e.g., directions and/or portions of a midsole structure, an outer sole structure, a fastening system, an upper, or any other components).

For consistency and convenience, directional adjectives are employed throughout this detailed description corresponding to the illustrated embodiments. The term "longitudinal" as used throughout this detailed description and in the claims refers to a direction or axis extending a length of a component (e.g., an upper or sole component). In some cases, a longitudinal direction may extend from a forefoot portion to a heel portion of the component. Also, the term "lateral" as used throughout this detailed description and in the claims refers to a direction or axis extending along a width of a component. In other words, a lateral direction may extend between a medial side and a lateral side of a component. Furthermore, the term "vertical" as used throughout this detailed description and in the claims refers to a direction or axis generally perpendicular to a lateral and longitudinal direction. For example, in cases where an article is planted flat on a ground surface, the vertical direction may extend from the ground surface upward. Additionally, the term "inner" refers to a portion of an article disposed closer to an interior of an article, or closer to a foot when the article is worn. Likewise, the term "outer" refers to a portion of an article disposed further from the interior of the article or from the foot. Thus, for example, the inner surface of a component is disposed closer to an interior of the article than the outer surface of the component. This detailed description makes use of these directional adjectives in describing an article and various components of the article, including an upper, a midsole structure and/or an outer sole structure.

Article 100 may be characterized by a number of different regions or portions. For example, article 100 could include a forefoot region, a midfoot region, a heel region, a vamp region, and an instep region. Moreover, components of article 100 could likewise comprise corresponding regions. Referring to FIG. 1, article 100 may be divided into forefoot region 10, midfoot region 12, and heel region 14. Forefoot region 10 may be generally associated with the toes and joints connecting the metatarsals with the phalanges. Midfoot region 12 may be generally associated with the arch of a foot. Likewise, heel region 14 may be generally associated with the heel of a foot, including the calcaneus bone. Article 100 may also include a vamp region 11 and an instep region 13. Vamp region 11 may be generally associated with the front part of a shoe upper that covers the toes and the area of the foot adjacent to the toes. Furthermore, instep region 13 may be generally associated with a center section of the foot, between the toes and ankle, adjacent to vamp region 11.

In addition, article 100 may include a lateral side 16 and a medial side 18. In particular, lateral side 16 and medial side 18 may be opposing sides of article 100. Furthermore, both lateral side 16 and medial side 18 may extend through forefoot region 10, midfoot region 12, heel region 14, vamp region 11, and instep region 13.

FIGS. 1-2 illustrate various features and components of article of footwear 100, including an upper 102 and a sole structure 130. FIG. 1 provides an isometric medial view of an embodiment of article 100. FIG. 2 provides an isometric lateral view of an embodiment of article 100. In FIGS. 1-2, upper 102 has an opening 104 that may receive a foot. Opening 104 may provide access to an interior cavity 106 of upper 102, as shown in FIGS. 1 and 2. Depending on the material of upper 102, in some embodiments, upper 102 may be configured to stretch fit over a foot without the need for additional fasteners. However, in other embodiments, the use of at least one tensile element 108 may allow upper 102 to enlarge or tighten over a foot and/or provide the amount of tension desired to keep article 100 on the foot. Thus, in some embodiments, one or more tensile element 108 may be configured to provide a kind of wraparound or wrapping tension to at least a portion of article 100.

In some embodiments, sole structure 130 may be configured to provide traction for article 100. For example, sole structure 130 may include one or more traction elements, such as grooves, protrusions, or other traction devices. In one embodiment, sole structure 130 may include areas with siping along the underside (i.e., the outsole) of sole structure 130. The siping may comprise thin slits across the surface of the outsole. In some embodiments, the siping may improve traction in wet or icy conditions.

In addition to providing traction, sole structure 130 may attenuate ground reaction forces when compressed between the foot and the ground during walking, running, pushing, or other ambulatory activities. The configuration of sole structure 130 may vary significantly in different embodiments to include a variety of conventional or non-conventional structures. In some cases, the configuration of sole structure 130 can be configured according to one or more types of surfaces on which sole structure 130 may be used. Examples of surfaces include, but are not limited to, natural turf, synthetic turf, dirt, hardwood flooring, skims, wood, plates, footboards, boat ramps, as well as other surfaces.

Sole structure 130 is secured to upper 102 and extends between the foot and the ground when article 100 is worn. In different embodiments, sole structure 130 may include different components. For example, sole structure 130 may include an outsole, a midsole, and/or an insole. In some cases, one or more of these components may be optional.

Furthermore, upper 102 may generally incorporate various provisions associated with uppers. In different embodiments, upper 102 may be configured to provide cushioning, tension, ventilation, shock absorption, energy return, support, as well as possibly other provisions.

Upper 102 may also be characterized by an exterior surface 112, which is an outer or exposed surface. In addition, upper 102 may include an interior surface 110 that is opposite exterior surface 112. Interior surface 110 may also define interior cavity 106 in some embodiments. Furthermore, in some embodiments, upper 102 includes a mouth 114 that provides entry for the foot into interior cavity 106 of upper 102. Furthermore, mouth 114 may be at least in part defined by a collar 128 that extends around the perimeter of the opening associated with mouth 114. Collar 128 may be understood to include the perimeter defined by the edges of mouth 114 as bounded by heel region 14 of upper 102, as well as a rear edge of a tongue portion 122 (discussed further below).

In different embodiments, different parts and components of upper 102 may be formed from a variety of different materials. Exemplary materials that could be used in various embodiments include, but are not limited to, expanded rubber, foam rubber, polymers, various kinds of foams, polyester, thermoplastics, polyurethane, nylon, Gore-Tex, leather, plastic, textiles, as well as possibly other materials. For example, in one embodiment, a tongue may be formed from a material that resists water. In another embodiment, portions of a tongue could be formed from a polymer foam material (i.e., provides cushioning). Other parts of upper 102 may be made from any of a plurality of materials or combination of materials, such as leather, leather-like materials, polymer materials, plastic materials, and textile fabrics and materials.

In the embodiment of FIGS. 1 and 2, article 100 may include a fastening system 120. Fastening system 120 can include provisions for facilitating the insertion of a foot or removal of a foot from article 100. Furthermore, in some embodiments, article 100 can further include provisions for protecting, cushioning, or otherwise dispersing the amount of force directed to various regions of a foot. In some embodiments, article 100 includes provisions for helping to secure or fasten upper 102 and sole structure 130 to a foot. Thus, in different embodiments, fastening system 120 could incorporate various fastening provisions or clasp elements including moveable regions, laces, tensile elements, clasps, buckles, straps, zippers, or other kinds of fasteners that may help secure upper 102 around a foot. In the embodiment of FIGS. 1 and 2, fastening system 120 can comprise a moveable assembly 140 and at least one tensile element 108. In one case, tensile element 108 may comprise a lacing element that may be routed around a portion of upper 102, as will be discussed below.

For purposes of reference, moveable assembly 140 can be demarcated to include different portions in some embodiments. As shown in FIGS. 1 and 2, moveable assembly 140 may include a throat portion 118 and a flap portion 148. In one embodiment, the shape of throat portion 118 may resemble a generally oblong rectangular or trapezoidal shape. Furthermore, the shape of flap portion 148 may include a generally rounded triangular or rectangular shape. However, in other embodiments, the perimeter and shape of any portion of moveable assembly 140 may vary from what is depicted here, and include any regular or irregular shape.

Thus, in different embodiments, the geometry of moveable assembly 140 could vary. In some embodiments, moveable assembly 140 may comprise a substantially flat or two-dimensional material or structure. The term "two-dimensional" as used throughout this detailed description and in the claims refers to any generally flat material exhibiting a length and width that are substantially greater than a thickness of the material. Although two-dimensional materials may have smooth or generally untextured surfaces, some two-dimensional materials will exhibit textures or other surface characteristics, such as dimpling, protrusions, ribs, or various patterns, for example. In other embodiments, the geometry of moveable assembly 140 could vary and could include various contours or features associated with parts of a foot, for example, the instep region of a foot. It should also be understood that in some embodiments, moveable assembly 140 may be disposed or joined to upper 102 in an asymmetrical manner. In other words, moveable assembly 140 may be joined along at least one edge to upper 102, but remain unanchored or unattached along another edge.

In addition, in various embodiments, moveable assembly 140 may also include fluid-filled chambers, padding, plates, moderators, or other elements that further attenuate forces, enhance stability, provide cushioning or protection, or influence the motions of the foot, for example. Furthermore, in some embodiments, moveable assembly 140 may include bumps or other irregular portions associated with padded regions.

Furthermore, moveable assembly 140 may include various edges associated with its perimeter. The following identifiers may be depicted in either or both of FIGS. 1 and 2, as the shift in perspective reveals various portions. In some embodiments, moveable assembly 140 may comprise a medial edge 156, a lateral edge 158, a forward edge 160, a first rear edge 162, and a second rear edge 164. In one embodiment, at least medial edge 156 and second rear edge 164 may be associated with throat portion 118. In another embodiment, at least lateral edge 158 and first rear edge 162 may be associated with flap portion 148. Furthermore, in some embodiments, a first segment 159 of forward edge 160 may be associated with flap portion 148, and a second segment 161 of forward edge 160 may be associated with throat portion 118.

In different embodiments, the dimensions of moveable assembly 140 could vary. In some embodiments, moveable assembly 140 has a width and a length that generally extends over a substantial portion of upper 102 associated with instep region 13. In another embodiment, moveable assembly 140 could have a length less than or greater than the length of instep region 13 along a longitudinal axis 180. In another embodiment, moveable assembly 140 may extend through both the forefoot portion and the midfoot portion. In other embodiments, moveable assembly 140 can include lengths that vary over different portions of moveable assembly 140, such that flap portion 148 has a greater length or lesser length than throat portion 118, for example.

Furthermore, in some cases, moveable assembly 140 may have a width that is generally constant throughout moveable assembly 140. In other embodiments, the width of moveable assembly 140 may vary along another dimension of moveable assembly 140. For example, moveable assembly 140 can curve or otherwise change in width along a lateral axis 190 in one embodiment. Thus, in one embodiment, moveable assembly 140 may extend over substantially the entire lateral width (along lateral axis 190) of upper 102, along midfoot region 12. In another embodiment, moveable assembly 140 may be wider along throat portion 118 relative to flap portion 148.

As noted above, in some embodiments, moveable assembly 140 may include throat portion 118. In some cases, throat portion 118 is generally associated with instep region 13 of article 100. In some embodiments, throat portion 118 extends from near collar 128 toward vamp region 11. In one embodiment, throat portion 118 is disposed approximately centrally on upper 102. In other embodiments, however, throat portion 118 may be positioned on lateral side 16 or on medial side 18 of upper 102.

In some embodiments, throat portion 118 is configured to be tightened or loosened around the foot of a wearer. For example, throat portion 118 may be loosened in order to allow a wearer to adjust his or her foot within interior cavity 106 or to slightly expand the width of upper 102 for a more comfortable fit. Similarly, throat portion 118 may be tightened to close upper 102 more tightly, in order to prevent the foot from unintentionally beingr extracted from upper 102 or to slightly decrease the width of upper 102 for a more comfortable fit.

Thus, the width associated with throat portion 118 may vary along different regions of throat portion 118. For example, in some embodiments, the region of throat portion more proximal to collar 128 may be wider than the region of throat portion 118 more proximal to vamp region 11. However, in other embodiments, the width may be substantially consistent or uniform throughout throat portion 118.

To alter the overall width of throat portion 118 and to secure throat portion 118 in position once a desired width has been achieved, throat portion 118 is provided with an eyelet region 132. Eyelet region 132 extends generally around throat portion 118 to partially surround throat portion 118. Eyelet region 132, which can be formed from a portion of the same or similar material as upper 102, includes a lateral portion 136 and a medial portion 134. As shown in FIGS. 1 and 2, eyelet region 132 also includes a plurality of eyelet holes 123 through which tensile element 108 is threaded. While ten eyelet holes 123 are provided in this embodiment, five on each side of throat portion 118, any number of eyelet holes 123 may be provided in other embodiments. For example, another embodiment may have no eyelet holes 123. It should also be understood that in some embodiments, one or more eyelet holes 123 may be disposed along upper 102, rather than along moveable assembly 140.

In some embodiments, the arrangement of lateral portion 136 generally mirrors the shape of medial portion 134, so that when lateral portion 136 is attached to upper 102, eyelet region 132 has the appearance of a single, continuous symmetrical region. In other embodiments, lateral portion 136 does not mirror medial portion 134 so that eyelet region 132 may have an asymmetrical appearance.

In the embodiment shown in FIGS. 1-2, tensile element 108 is a single lace threaded through eyelet holes 123 to form a criss-cross pattern or arrangement across throat portion 118. However, in other embodiments, multiple laces or tensile elements may be provided, or the lace(s) may be threaded through eyelet holes 123 in any type of configuration or pattern. In some embodiments, tensile element 108 is made from an elastic or other slightly stretchy material, although in other embodiments tensile element 108 may be made from a fixed length material, such as woven cotton or leather.

Again referring to FIGS. 1 and 2, in some embodiments, upper 102 may include provisions that provide cushioning and support across the instep of a foot. Such provisions may also allow article 100 to be more adjustable for a user, and facilitate the removal and entry of a foot into article 100. As shown in FIGS. 1-2, in one embodiment, tongue portion 122 is disposed on or is adjacent to the top part of the foot when article 100 is worn by a user. One purpose of tongue portion 122 may be to protect the top of the foot. In other cases, tongue portion 122 may help keep various fastening elements from rubbing or otherwise discomforting the foot. Tongue portion 122 may also serve a decorative purpose in some embodiments.

In different embodiments, tongue portion 122 may include features similar to that of a conventional tongue in an article of footwear. In one embodiment tongue portion 122 is provided such that it is disposed throughout throat portion 118. Thus, in some cases, tongue portion 122 may extend substantially throughout the region of throat portion 118 associated with the width of throat portion 118.

Furthermore, referring to FIGS. 1 and 2, in some embodiments, tongue portion 122 may be constructed to be a unitary piece element disposed within throat portion 118 of moveable assembly 140. In one embodiment, the inclusion of tongue portion 122 may be unitarily integrated or continuous (one-piece) with moveable assembly 140. Thus, the width of throat portion 118 may be substantially similar to a width of tongue portion 122 in some embodiments. In other embodiments, as shown in FIGS. 1 and 2, tongue portion 122 may extend between lateral portion 136 and medial portion 134 of throat portion 118.

Furthermore, second segment 161 of forward edge 160 may be adjacent to an instep portion 116 in some embodiments, as shown in FIGS. 1 and 2. Instep portion 116 can be fixedly attached to vamp region 11 of upper 102. In addition, in one embodiment, instep portion 116 can contact and/or includes at least a portion of tensile element 108. Furthermore, instep portion 116 can include one or more eyelet holes 123. Thus, instep portion 116 can provide a link between moveable assembly 140 along forward edge 160 in instep region 13 with upper 102, ensuring continuous coverage of a foot that is inserted within interior cavity 106. In one embodiment, instep portion 116 is attached at or near the point at which throat portion 118 transitions to vamp region 11. In some cases, instep portion 116 is made from an elastic material or an elastic material covered with another material so that instep portion 116 may be slightly stretched for ease of foot insertion. In some embodiments, instep portion 116 can be used to more securely hold the wearer's foot within article of footwear so that the foot is not accidentally or unintentionally extracted from article of footwear 100 while walking or running. However, in other embodiments, throat portion 118 may be joined directly to vamp region 11 of upper 102, and there may be no instep portion 116.

In some embodiments, the continuous, smooth configuration of tongue portion 122 within moveable assembly 140 illustrated in FIGS. 1 and 2 may provide a user with relatively greater comfort or fit in some embodiments. In one embodiment, the inclusion of moveable assembly 140 unitarily integrated or continuous with tongue portion 122 can reduce the bumpiness of the external and/or internal surface of article 100. In another embodiment, a substantially continuous tongue portion 122 along moveable assembly 140 can help minimize possible snagging of the upper with other objects. In addition, because there is a continuous unbroken region (i.e., closed surface) extending over instep region 13, there is less likelihood of debris or other particles entering interior cavity 106.

Furthermore, in the embodiments disclosed herein, article 100 may provide a user with greater comfort. For example, in cases where tongue portion 122 is continuous with medial side 18 of upper 102, tongue portion 122 can be more stable, and provide user with a smooth surface.

It should be understood that in some embodiments, the freedom of movement allowed tongue portion 122 may be associated with extent to which tongue portion 122 is associated with moveable assembly 140. In different embodiments where at least a portion of tongue portion 122 is separate from moveable assembly 140, tongue portion 122 may be less limited or more limited in its range of movement. In other embodiments, tongue portion 122 may be more or less anchored to upper 102 than depicted herein.

Furthermore, the materials comprising tongue portion 122 may also affect the ability of tongue portion 122 to be adjusted or moved. Thus, in some embodiments, tongue portion 122 may include substantially flexible materials, allowing tongue portion 122 to be bent or curved back, giving the user more easy access to interior cavity 106, for example. In other embodiments, tongue portion 122 may include substantially rigid materials that inhibit the bending of tongue portion 122 and increase the amount of resistance of tongue portion 122 to deformation. In another embodiment, tongue portion 122 may include areas that are more flexible and areas that are more rigid.

In different embodiments, one or more portions of moveable assembly 140 may be separably attached to article 100 to allow for the manipulation of moveable assembly 140 with respect to upper 102. Furthermore, article 100 may include provisions for adjustment of moveable assembly 140 in some embodiments. In one embodiment, moveable assembly 140 may be rotated, pivoted, swiveled, swung, or otherwise moved back and forth along a flexible region along upper 102. In another embodiment, moveable assembly 140 may be turned in a manner similar to a page that is bound to the spine of a book. The degree of rotation about a flexible region (or hinge) permitted to moveable assembly 140 may vary in different embodiments. In some cases, moveable assembly 140 may be configured for rotation of over 180 degrees. In other cases, rotation may be limited to less than 180 degrees, or be substantially close to 90 degrees.

Thus, in some embodiments, moveable assembly 140 may be peeled or pulled away from upper 102, as shown in FIGS. 3-6. This may be facilitated by the inclusion of a hinge portion 154 (best seen in FIG. 1). Hinge portion 154 can comprise a region where a component or portion of article 100 is joined, attachment, or otherwise secured to another portion of article 100. For example, the attachment may be formed through sewing, stitching, fusion, bonding, glue (by an adhesive or other agents), or a combination of thereof. In some cases, hinge portion 154 can provide a high level of strength and stability, and/or can also be used to provide design or ornamental enhancements to article 100. In some embodiments, the inclusion of a smooth, continuous region between tongue portion 122 and upper 102 via hinge portion 154 may also facilitate the manufacturing of article 100. In another embodiment, the continuous region between tongue portion 122 and upper 102 can as improve the resilience of moveable assembly 140 to displacement and/or improve the ability of tongue portion 122 to withstand repeated deformation and/or exposure to various pulling forces. The operation of moveable assembly 140 relative to hinge portion 154 will be discussed further in reference to FIGS. 3-6 below.

Thus, in some embodiments, article 100 can be adjusted to vary the size of opening 104. In one embodiment, fastening system 120 as described herein may be utilized to adjust opening 104 to facilitate entry or exit of a foot, for example. While FIGS. 1 and 2 show article 100 with upper 102 in a closed configuration, FIGS. 3-6 show article 100 with upper 102 in an at least partially open configuration.

In some embodiments, hinge portion 154 may be configured to allow the bending or partial deformation of at least some of moveable assembly 140. In some embodiments, medial portion 134 of throat portion 118 along moveable assembly 140 can be disposed adjacent to or be associated with hinge portion 154. Thus, in some embodiments, medial portion 134 may be fixedly attached to upper 102. In some embodiments, only the regions of moveable assembly 140 distinct or disposed away (here, toward lateral side 16) from hinge portion 154 are separable from upper 102. Thus, while medial edge 156 of moveable assembly 140 is generally anchored to upper 102, the remaining areas of moveable assembly 140 (for example, flap portion 148 along lateral side 16) may be rotated, turned, lifted, or otherwise moved in some embodiments.

Hinge portion 154 can generally bind one side of moveable assembly 140 to a portion of upper 102. The materials comprising moveable assembly 140 may also affect the ability of moveable assembly 140 to be adjusted, or moved. Thus, in some embodiments, moveable assembly 140 may include substantially flexible materials, allowing moveable assembly 140 to be bent or curved back, giving the user more easy access to interior cavity 106, for example. In other embodiments, moveable assembly 140 and hinge portion 154 may include substantially rigid materials that inhibit the bending of moveable assembly 140 and increase the amount of resistance of moveable assembly 140 to deformation. In another embodiment, moveable assembly 140 and upper 102 may include areas that are more flexible and areas that are more rigid.

In some embodiments, attaching medial portion 134 to upper 102 in a non-removable manner (i.e., via hinge portion 154) while the remainder of moveable assembly 140 is separably attached to upper 102 can allow a user to more readily access flap portion 148 associated with lateral side 16. Medial portion 134 may be attached to upper 102 by any method known in the art, such as by stitching or with an adhesive. In another embodiment, medial portion 134 is formed integrally with upper 102. In such an embodiment, medial portion 134 may optionally be outlined by stitching, printing, or other decorative elements. However, while benefits to hinge portion 154 being disposed along medial side 18 are noted here, it should be understood that in other embodiments, hinge portion 154 may be disposed along lateral side 16 of article 100 if so desired.

Thus, as described above, article 100 may include provisions for securing the foot into article 100. Fastening system 120 may be designed to help secure the foot, and support the foot's structure in some embodiments. Referring to FIGS. 3-6, a sequence of figures depicting the use of an embodiment of a fastening system is shown. Fastening system 120 and/or upper 102 may include a secured state or closed configuration, where moveable assembly 140 and tensile element 108 are tightened and/or providing tension. In the secured state, as described further below with respect to FIGS. 3-6, fastening system 120 may exert a compressive force along at least a portion of instep region 13. In addition, in one embodiment, upper 102 may be in the secured state when throat portion 118 is disposed to extend over the center of instep region 13, and flap portion 148 is disposed adjacent to and extends over a portion of lateral side 16 of upper 102.

Furthermore, fastening system 120 and upper 102 may include an open state, where moveable assembly 140 and/or tensile element 108 has been loosened, and various components are free to move in different directions. In one embodiment, upper 102 may be in the open state when fastening system 120 is loosened, moveable assembly 140 is swiveled, rotated, turned, or bent toward medial side 18, and at least a portion of tongue portion 122 is pulled away from instep region 13. In some embodiments, a user may adjust moveable assembly 140 and/or tensile element 108 to secure a foot in article 100 and transition article 100 from the open state to the secured state, or transition article 100 from the secured state to the open state, as will be discussed below.

In some embodiments, moveable assembly 140 may include provisions for easy grasp or grip of moveable assembly 140. As shown in FIGS. 3-6, a pull tab 310 may be joined along a lateral side 16 of flap portion 148. In some embodiments, a user may insert at least one finger into pull tab 310 to carry and/or pull article 100 away from his or her foot. In one embodiment, pull tab 310 may be used to pull moveable assembly 140 in different directions. For example, a person may grasp pull tab 310 and pull upward to lift moveable assembly 140 away from upper 102, or to pivot moveable assembly 140 from lateral side 16 toward medial side 18. Other embodiments may include different configurations providing a similar function. In some embodiments, pull tab 310 may be joined to a clasp element 340 along flap portion 148 to facilitate the separation of moveable assembly 140 from upper 102, and/or to facilitate the securing of moveable assembly 140 to upper 102. Various configurations of different clasp elements that may be included with article 100 will be discussed further below with respect to FIGS. 9-12.

For purposes of reference, in some embodiments, moveable assembly 140 may include a first surface 320 and a second surface 330. In some cases, first surface 320 may represent a generally opposing side to second surface 330. Furthermore, the region of upper 102 that is directly below and corresponds to flap portion 148 when fastening system 120 is in the closed configuration can be referred to as a third surface 370. Thus, third surface 370 of upper 102 remains covered or generally non-visible when fastening system 120 is in the closed configuration.

As noted above, in some embodiments, article 100 may include provisions that facilitate the insertion of a foot into article 100, and allow rapid entry. Furthermore, similar provisions may facilitate the removal or rapid exit of a foot from article 100. Referring to the sequence of embodiments of article 100 depicted in FIGS. 3-6, it can be seen that in some embodiments, as article 100 is loosened and components of upper 102 are adjusted, the entryway leading into interior cavity 106 may change in size and shape. In FIGS. 1-2, fastening system 120 is fully engaged, and upper 102 is in the secured state. For purposes of reference, the different sizes of opening 104 depicted in FIGS. 3-6 are identified by a dotted line associated with the boundary of opening 104. It should be understood that the sizes depicted by the dotted lines are for illustrative purposes only, and the shapes and/or size of opening 104 may differ from those shown or labeled herein.

Figure 3:
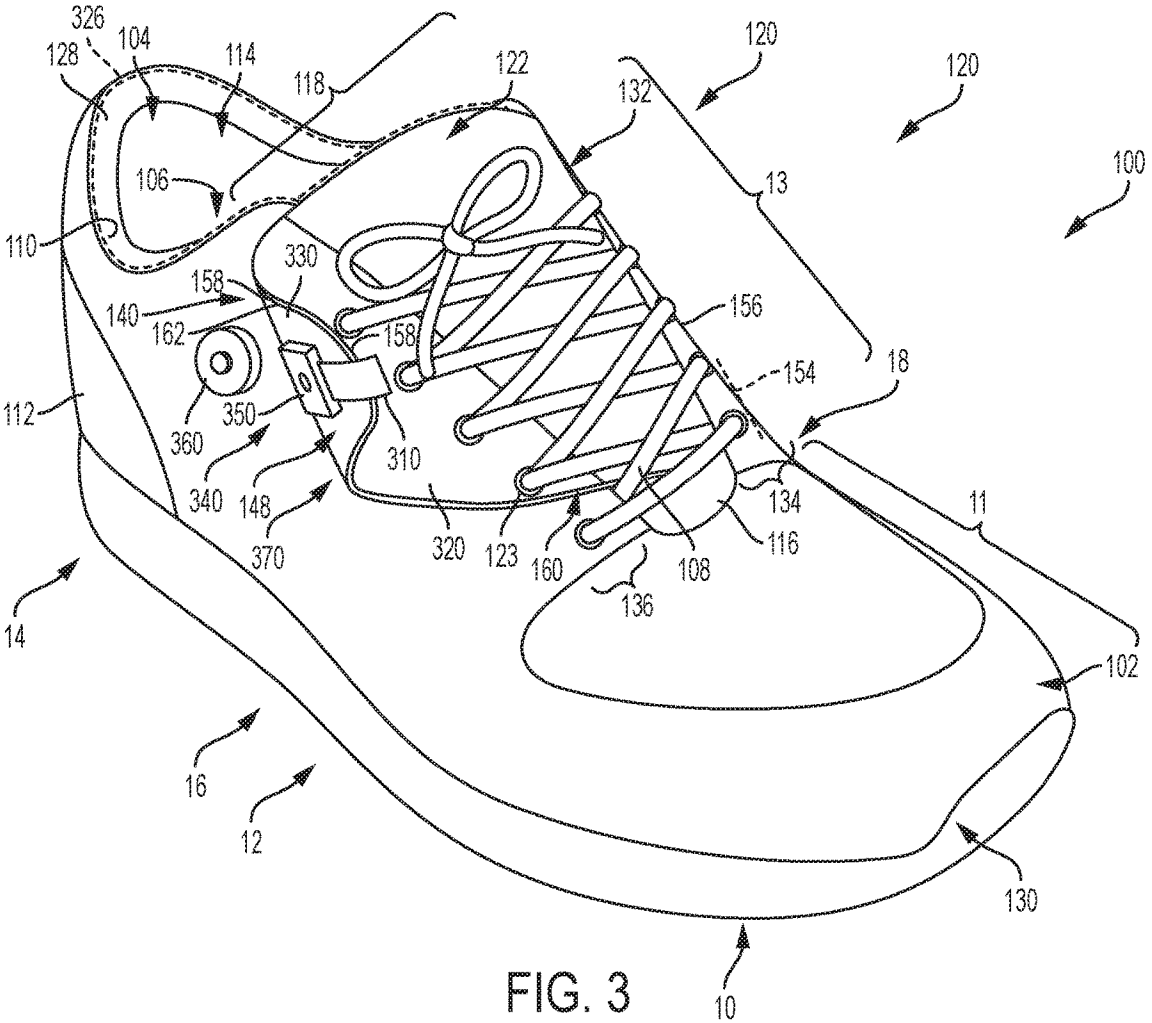
FIG. 3 is a schematic isometric view of an embodiment of an article of footwear including a fastening system with a moveable assembly.

In the embodiment of FIG. 3, a portion of flap portion 148 has been raised, but instep region 13 remains substantially covered, and so opening 104 continues to have a first size 326 that is substantially similar to the size of opening 104 in FIGS. 1-2. In FIGS. 1, 2, and 3, the size of opening 104 is generally defined by the region associated with mouth 114, which is bounded by collar 128 and second rear edge 138 of moveable assembly 140.

Figure 4:
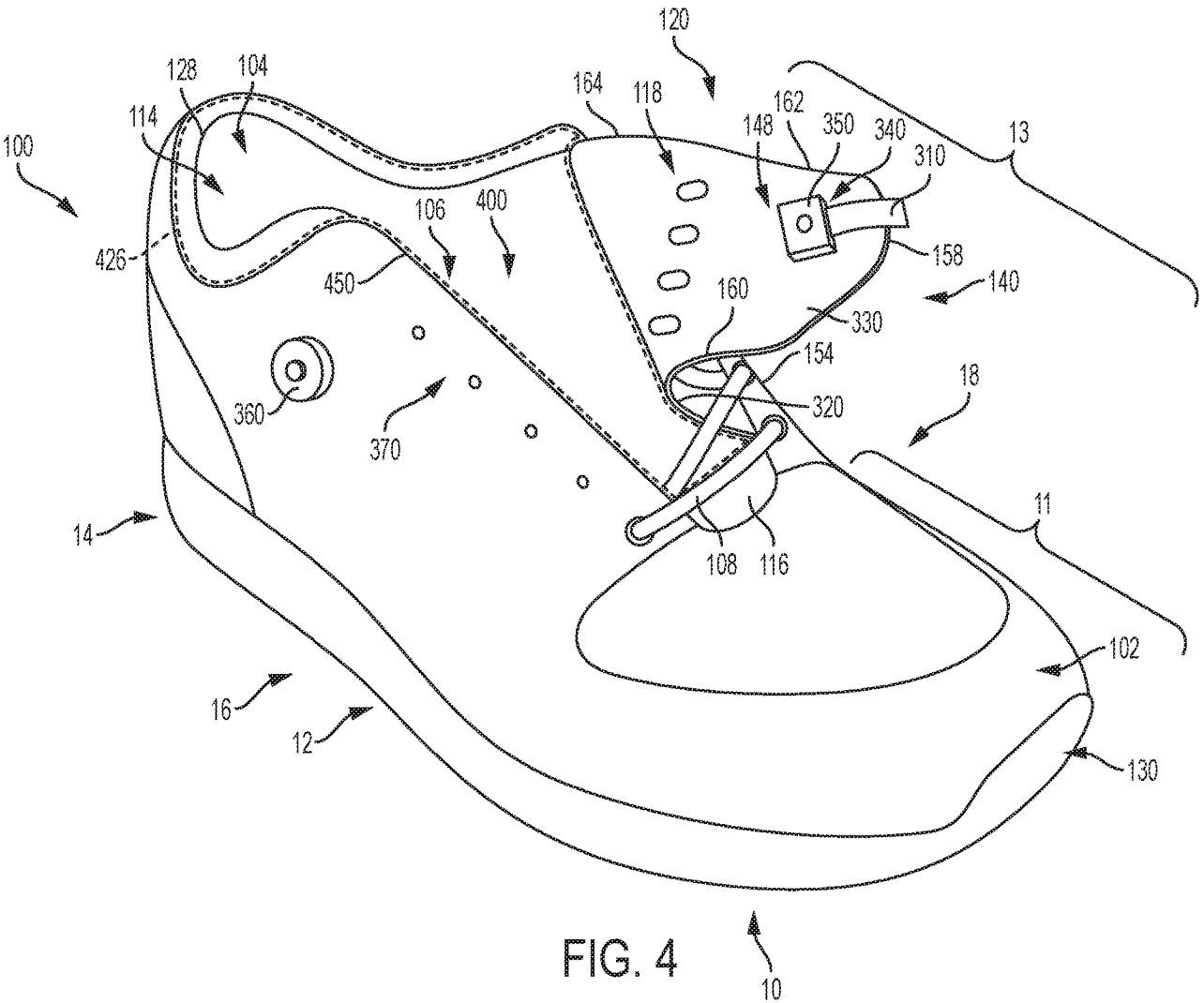
FIG. 4 is a schematic isometric view of an embodiment of an article of footwear including a fastening system with a moveable assembly.

Referring now to FIG. 4, throat portion 118 (including a portion of tensile element 108) has been partially turned upward and/or deformed. In FIG. 4, opening 104 has a second size 426, which is now defined by both mouth 114 and a small portion of a throat opening 400. Throat opening 400 is associated with the gap that may be formed between a portion of second surface 330 of throat portion 118 and a lateral instep edge 450 of upper 102. The opening of throat opening 400 can be used to expand the overall opening 104 leading to interior cavity 106. Thus, in some embodiments, second size 426 is larger in area than first size 326.

Figure 5:
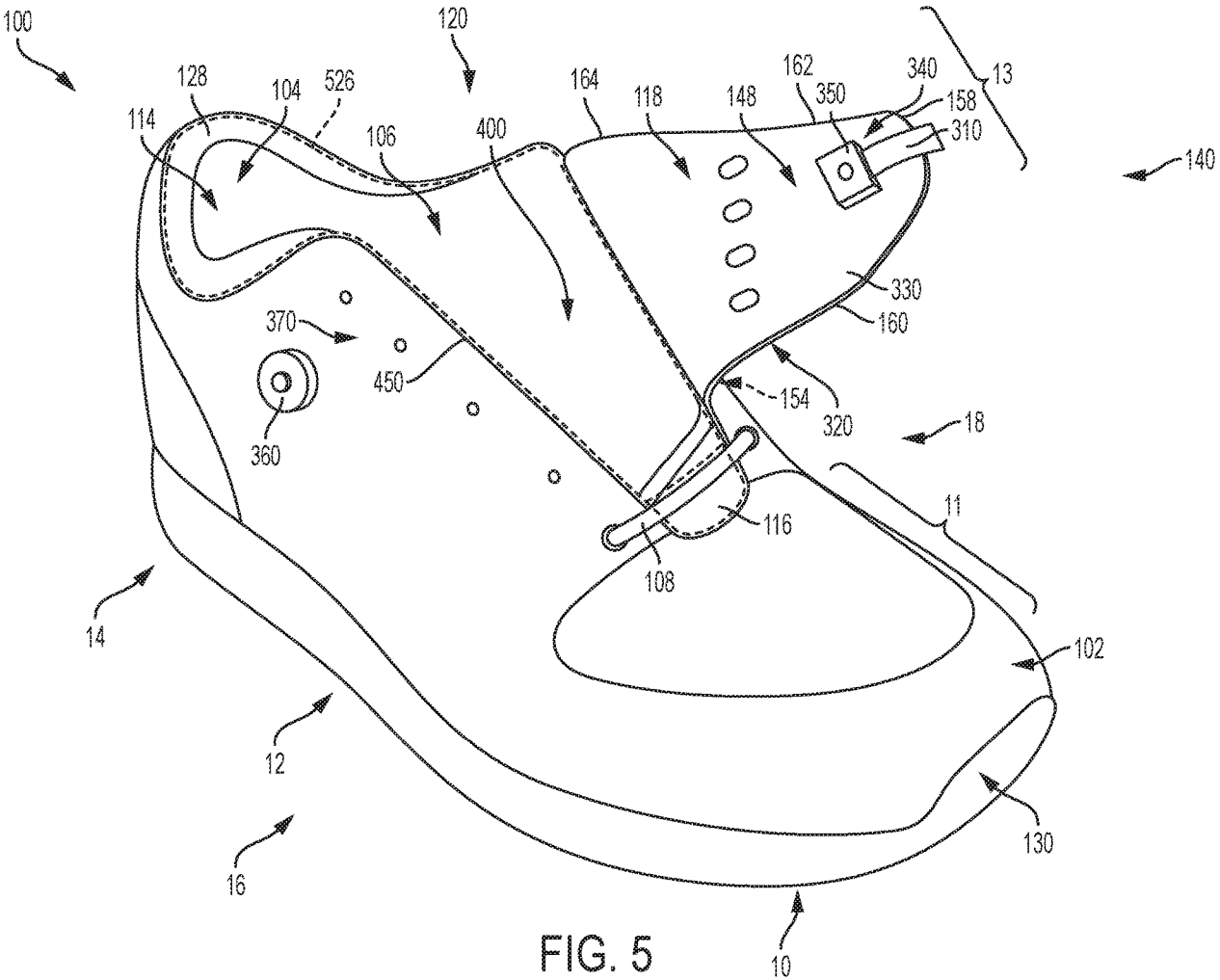
FIG. 5 is a schematic isometric view of an embodiment of an article of footwear including a fastening system with a moveable assembly.

In FIG. 5, moveable assembly 140 has been further bent toward medial side 18. In some embodiments, moveable assembly 140 may now be at least partially deformed or bent along hinge portion 154 (shown in FIG. 1). As shown in FIG. 5, opening 104 has a third size 526, which is defined by both mouth 114 and a relatively larger opening formed in throat opening 400. In some embodiments, third size 526 may be larger in area than second size 426 (shown in FIG. 4), allowing greater or more ready access to interior cavity 106.

Figure 6:
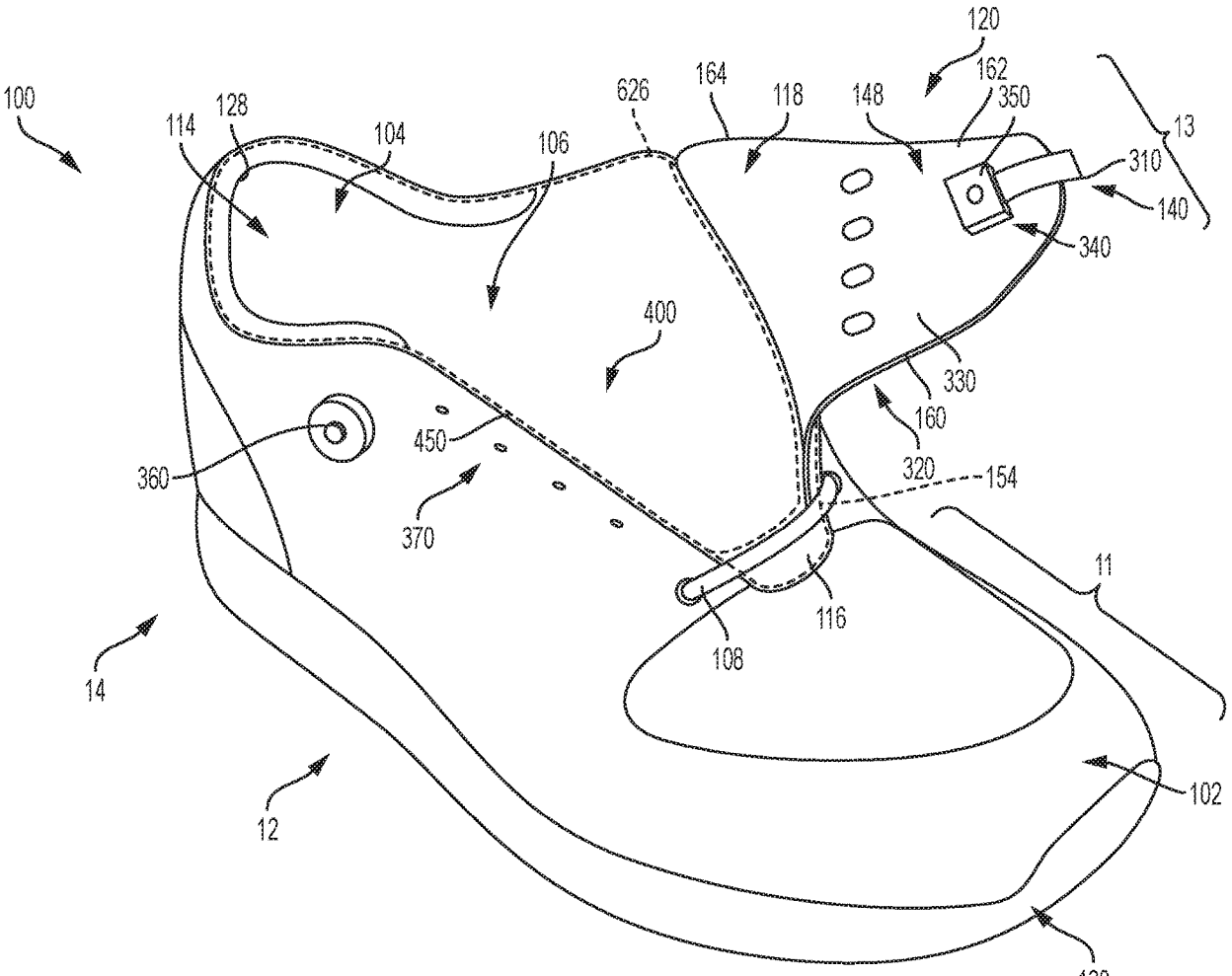
FIG. 6 is a schematic isometric view of an embodiment of an article of footwear including a fastening system.

In FIG. 6, moveable assembly 140 has been further bent toward medial side 18. In some embodiments, moveable assembly 140 may now be substantially deformed or bent along hinge portion 154 (shown in FIG. 1). Furthermore, lateral instep edge 450 may be bent or deformed outwards toward lateral side 16, further increasing the size of throat opening 400. As shown in FIG. 6, opening 104 now has a fourth size 626, which is defined by both mouth 114 and the relatively larger opening formed in throat opening 400. Opening 104 now has a fourth size 626 that may be greater than third size 526 (shown in FIG. 5) in some embodiments. In some embodiments, opening 104 can extend between heel region 14 and vamp region 11.

In other embodiments, mouth 114 and/or throat opening 400 may be further expanded, and opening 104 may increase in size to a size that is larger in area than fourth size 626. In some embodiments, throat opening 400 may extend along a generally lateral direction between lateral instep edge 450 and hinge portion 154. Thus, although moveable assembly 140 is attached to upper 102 along its medial edge 156 (shown in FIG. 1), it remains highly moveable. In other words, because moveable assembly 140 remains free along first rear edge 162, second rear edge 164, lateral edge 158, and forward edge 160, it has the ability to be turned or bent to a large degree, exposing a significant area of throat opening 400. In FIG. 6, where upper 102 is in the open configuration or state, fourth size 626 may represent the maximum size of opening 104. However, it should be understood that, in other embodiments, opening 104 may have a maximum size substantially greater than or less than that of fourth size 626. For example, depending on the flexibility or thickness of the materials used in moveable assembly 140, moveable assembly 140 may have the ability to bend less or further toward medial side 18 of article 100 and form a larger opening.

Figure 7:
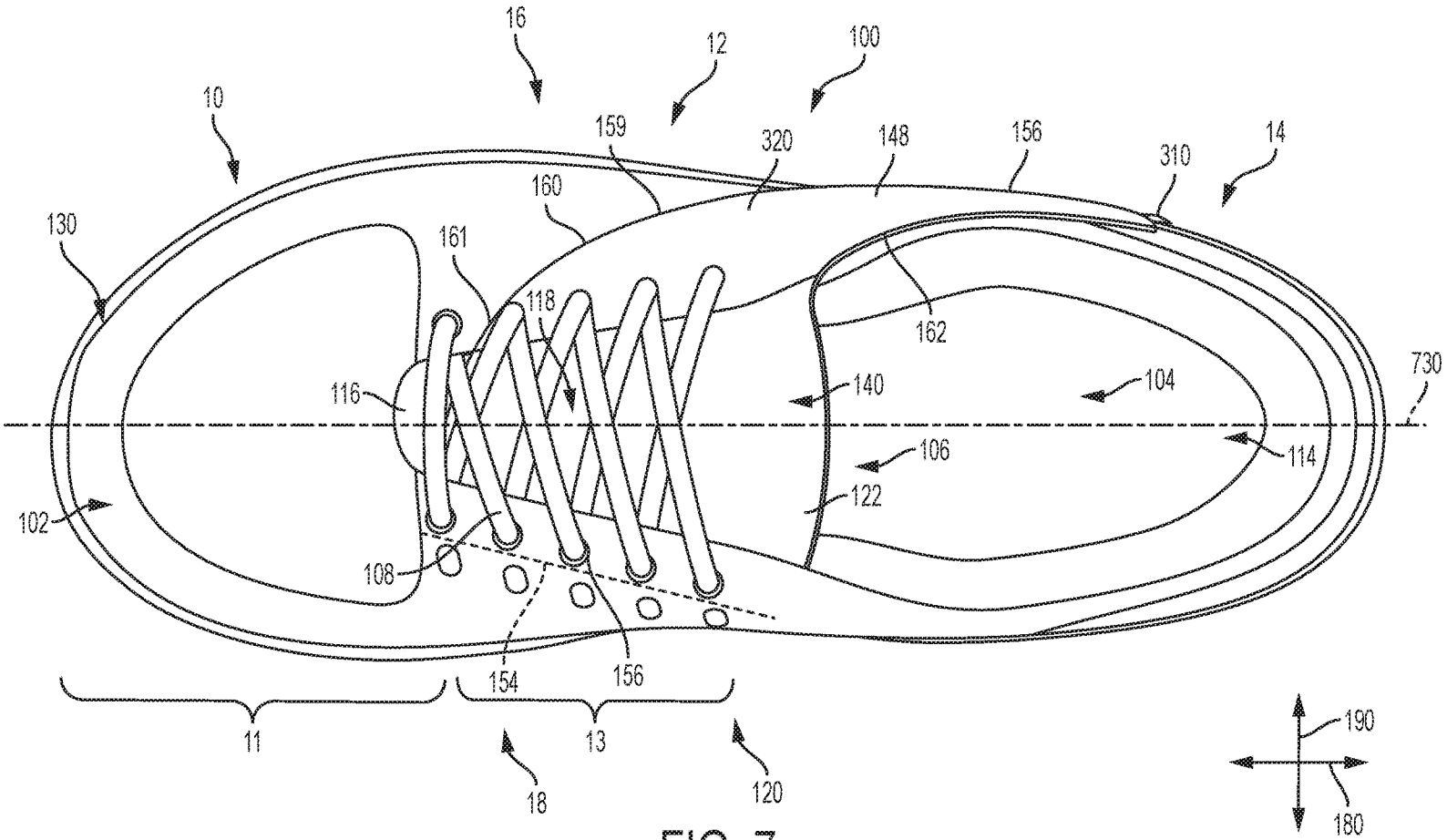
FIG. 7 is a schematic top-down view of an embodiment of an article of footwear including a fastening system.
Figure 8:
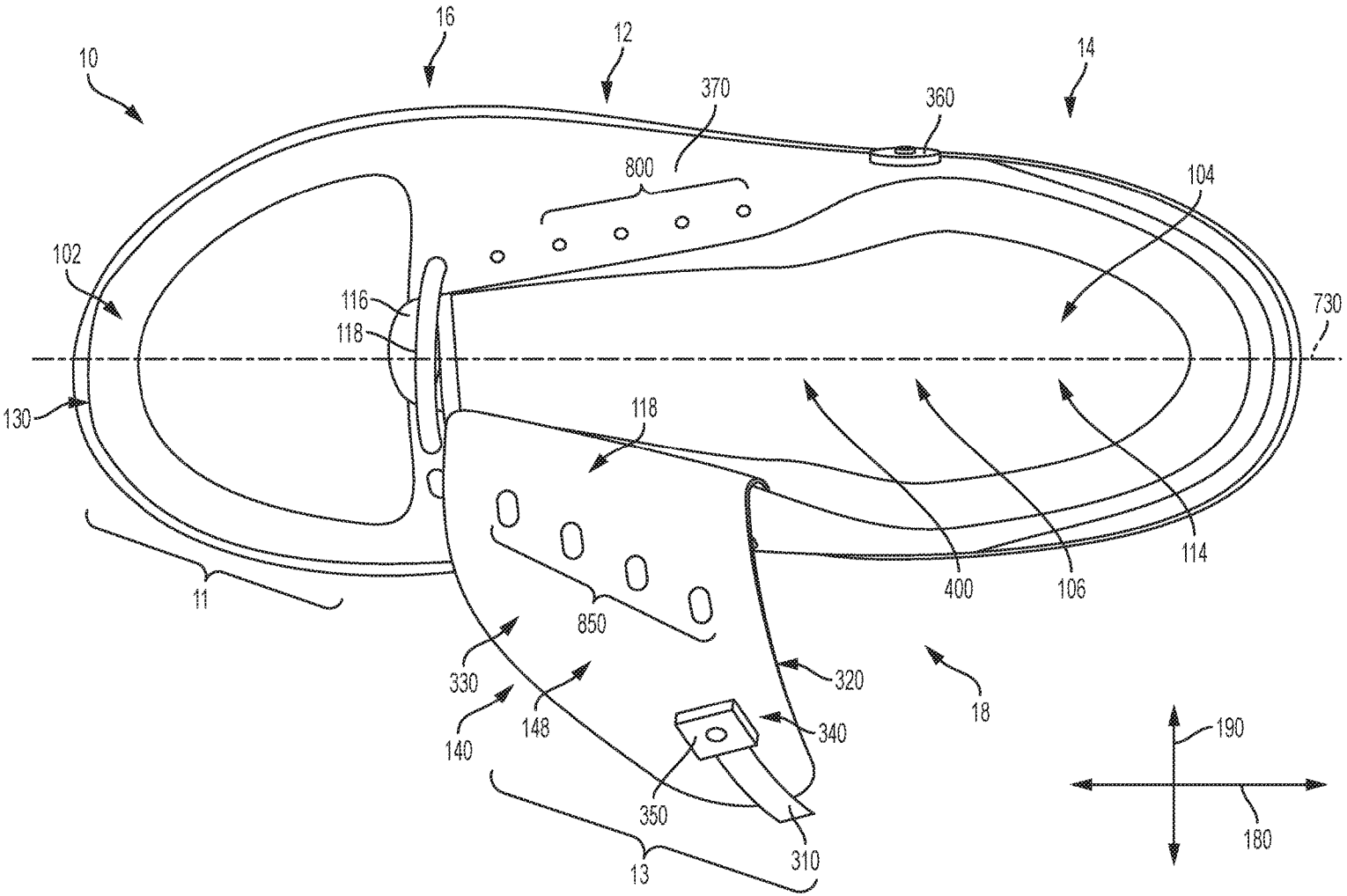
FIG. 8 is a schematic top-down view of an embodiment of an article of footwear including a fastening system.

With each enlargement of opening 104 as described herein, a user may be able to more readily slip on article 100 or remove article 100. In some embodiments, the quick release of fastening system 120 can permit a user to rapidly remove a foot and/or enter a foot into article 100. Furthermore, the configuration of moveable assembly 140, which may substantially rotate or fold (similar to a flap) over instep region 13, may provide a user with a swift-motion mechanism for setting aside a portion of the layer associated with instep region 13. This may allow a user to quickly expand or decrease the size of at least a portion of throat opening 400 in some embodiments. This relatively significant increase in size can be best seen in the top-down views of article 100 provided in FIGS. 7 and 8. In FIG. 7, article 100 is in the closed configuration, and in FIG. 8, article 100 is in the open configuration. It can be seen that due to the pivoting feature of moveable assembly 140 along hinge portion 154, a user may be provided with prompt access to a larger opening leading to interior cavity 106. In some embodiments, it may also be desired that opening 104 be sized more widely (as shown herein), in comparison with conventional footwear (for example, shoes used in sports like baseball or track). For example, a larger opening 104 may also allow a person with assistive devices, prosthetics or other elements adjoining a foot or a foot prosthetic to readily insert to or exit from interior cavity 106.

It should be understood that moveable assembly 140 may be disposed such that the gap associated with throat opening 400 is configured toward medial side 18, rather than lateral side 16 (as shown in FIGS. 1-8). In other words, in another embodiment, moveable assembly 140 may be arranged such that it is attached to upper 102 along lateral side 16, and detached along medial side 18. Thus, descriptions provided herein and in the claims may refer to two sides of article 100 demarcated by a central axis 730 (shown in FIGS. 7 and 8). Central axis 730 may extend in a direction parallel to a longitudinal axis 180. In one embodiment, central axis 730 may be generally equivalent to or aligned with a midline extending across the length of upper 102 in a longitudinal direction. Central axis 730 may, in some cases, help demarcate article 100 into a first side and a second side along the lateral direction (as represented by a lateral axis 190). The first side may be associated with lateral side 16, for example, and the second side may represent the corresponding medial side 18. In another case, the first side may be associated with medial side 18, and the second side may represent the corresponding lateral side 16. While the first side and the second side may not be identical (similar to the manner in which lateral side 16 and medial side 18 are not identical), they may include similar regions and sizes across upper 102.

As noted above, referring to FIGS. 3-6, in some embodiments, moveable assembly 140 may include clasp element 340. Clasp element 340 may be a component joined to a portion of article 100 to allow users to clip, buckle, attach, detach, connect or otherwise securely attach one region of article 100 to another region, while also allowing user to readily detach the two regions. In some embodiments, the component may be an independent element from upper 102. Clasp element 340 may also be a component that facilitates the adjustment of fastening system 120.

Thus, in different embodiments, clasp element 340 may comprise a buckle, loop, button, releasable catch, ring, magnetic contact, snaps, a zipper, a hook-and-loop closure system such as Velcro, or other element providing a point of anchor or attachment to a portion of moveable assembly 140. Clasp element 340 may be made of any material, including textiles, or more rigid materials such as plastic or a metal material. In some embodiments, clasp element 340 may comprise multiple portions and materials disposed in different regions of article 100. In one embodiment, clasp element 340 may comprise a first part and a second part. In some cases, first part may be configured to join with or connect to second part. For example, a first portion 350 associated with a first region of article 100 may contact a second portion 360 associated with a second region of article in order to connect or secure the two regions together. Other embodiments of clasp element 340 may include only one portion, or more than two portions.

Referring to FIGS. 3-6, first portion 350 is depicted disposed on and fixedly attached to second surface 330 of flap portion 148. Furthermore, second portion 360 of clasp element 340 is depicted disposed on and fixedly attached to third surface 370 of upper 102. In different embodiments, first portion 350 and second portion 360 are configured to engage with each other to secure moveable assembly 140 to upper 102 when first portion 350 and second portion 360 are pressed together, such as with the fingers or hand of the wearer.

In different embodiments, various types of clasp elements may be incorporated in article 100, as noted above. In some embodiments, the embodiments disclosed herein may include a clasp element that is configured for use for individuals who rely or are benefited by assistive technology. In other words, article 100 may be configured to be utilized by a person who has a disability or who is physically challenged. Thus, a clasp element can facilitate easy access to article 100.

Some examples of different types of apparatuses or devices that can be utilized to facilitate the transition between the open configuration and the closed configuration of the article, and/or to help secure the moveable assembly to the upper, are disclosed in Fiedler, U.S. Pat. No. 7,889,036, issued Feb. 15, 2011, titled "Magnetic Holding Device" (previously PCT Number PCT/DE2006/000418 filed Mar. 9, 2006); Fiedler, U.S. Pat. No. 8,353,544, issued Jan. 15, 2013, titled "Locking Magnet Closure" (previously PCT Number PCT/DE2009/000090 filed Jan. 27, 2009); Fiedler, U.S. Pat. No. 8,368,494 issued Feb. 5, 2013, titled "Magnetic Coupling Device" (previously PCT Number PCT/DE2008/002028 filed Dec. 4, 2008); Fiedler, U.S. Pat. No. 8,739,371 issued Jun. 3, 2014, titled "Locking Device" (previously U.S. patent application Ser. No. 13/298,787 filed Nov. 17, 2011); Fiedler, U.S. Pat. No. 8,794,682 issued Aug. 5, 2014, titled "Closure Device for Connecting Two Parts" (previously PCT Number PCT/EP2010/050805 filed Jan. 25, 2010); and Fiedler, U.S. Pat. No. 8,851,534, issued Oct. 7, 2014, titled "Magnetic Closure with an Opening-Assisting Spring" (previously PCT Number PCT/DE2008/001161 filed Jul. 12, 2008), the entirety of each application being herein incorporated by reference.

Figure 9:
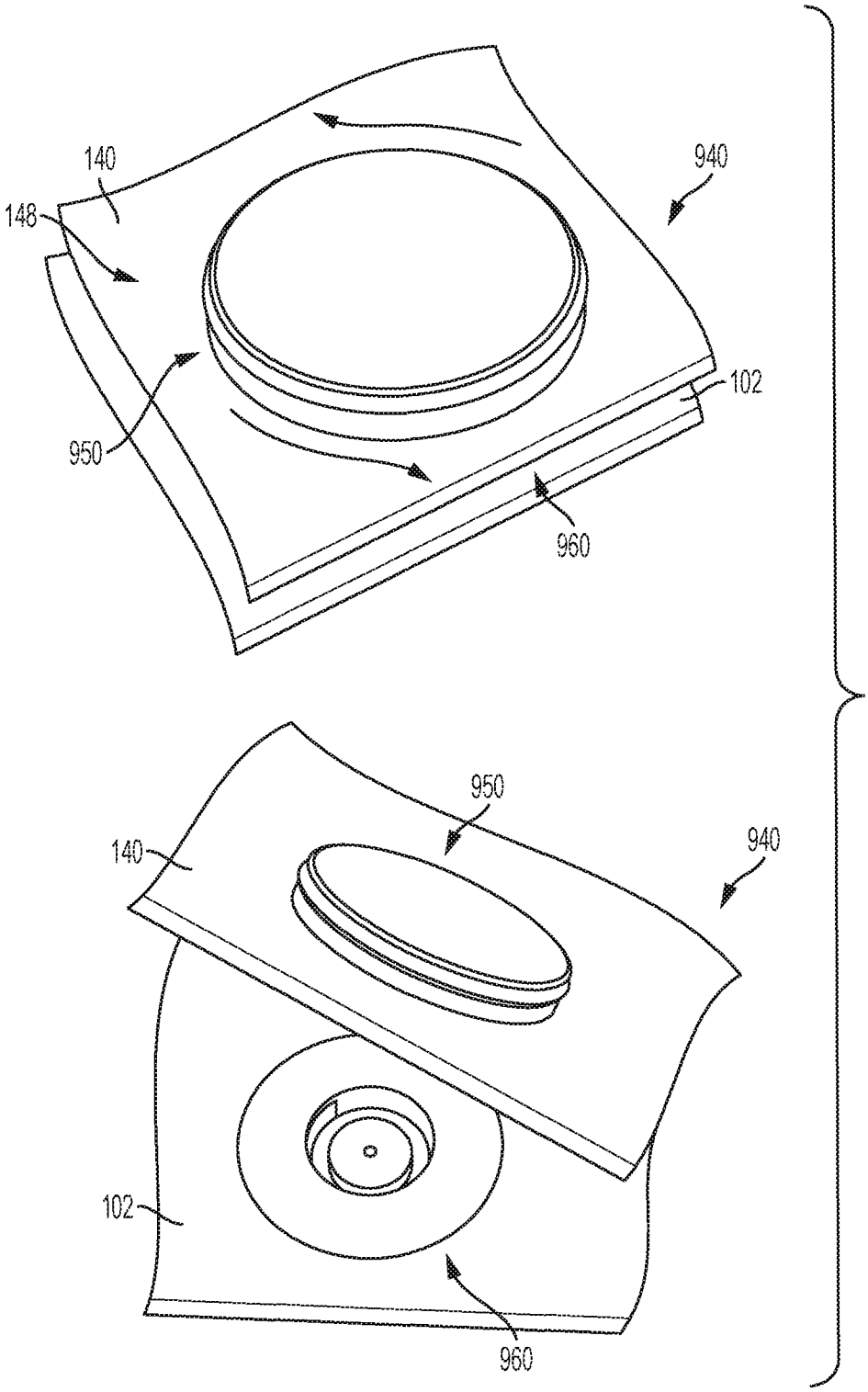
FIG. 9 is a schematic isometric view of an embodiment of a clasp element.
Figure 10:
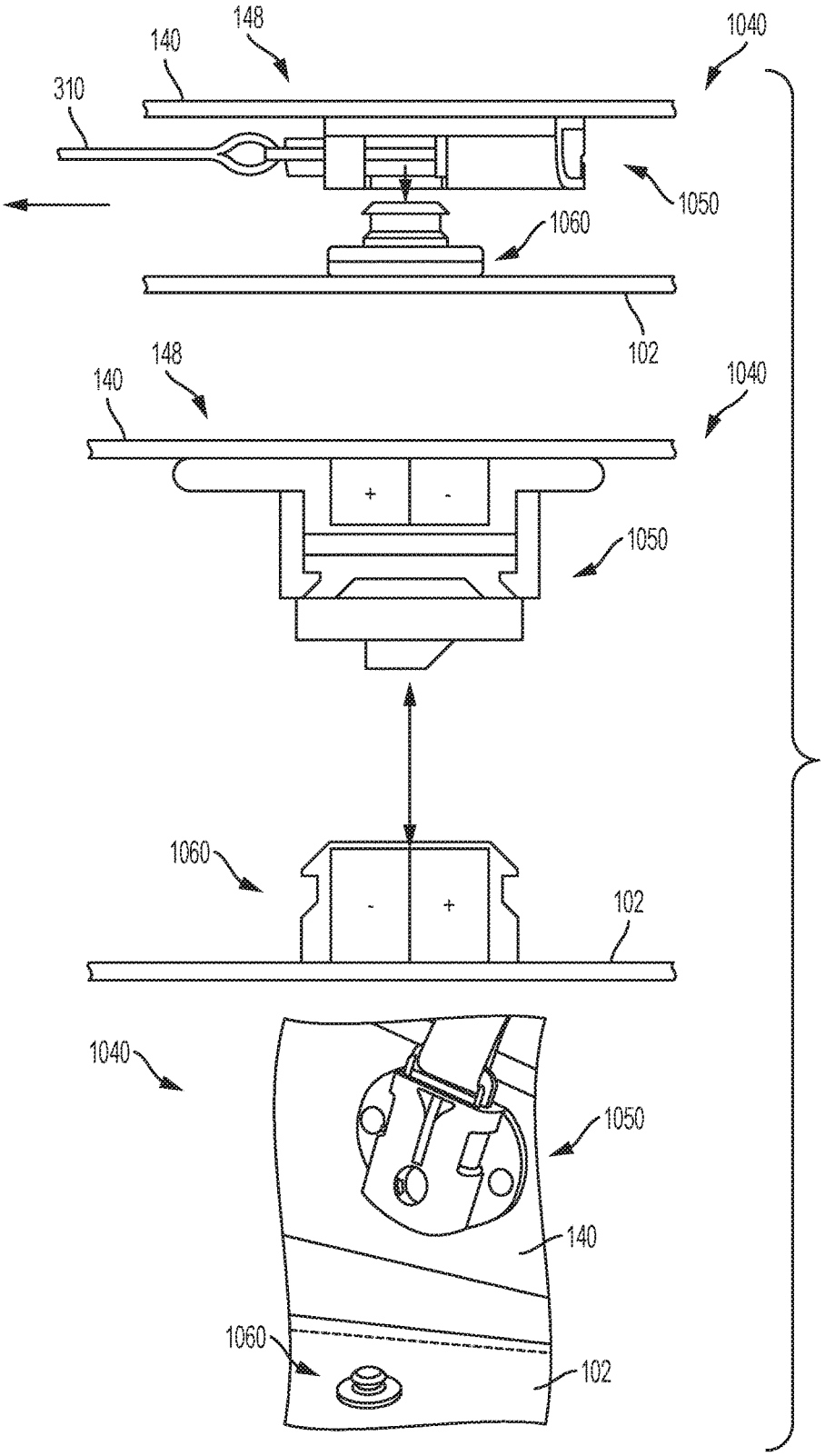
FIG. 10 is a schematic isometric view of an embodiment of a clasp element.
Figure 11:
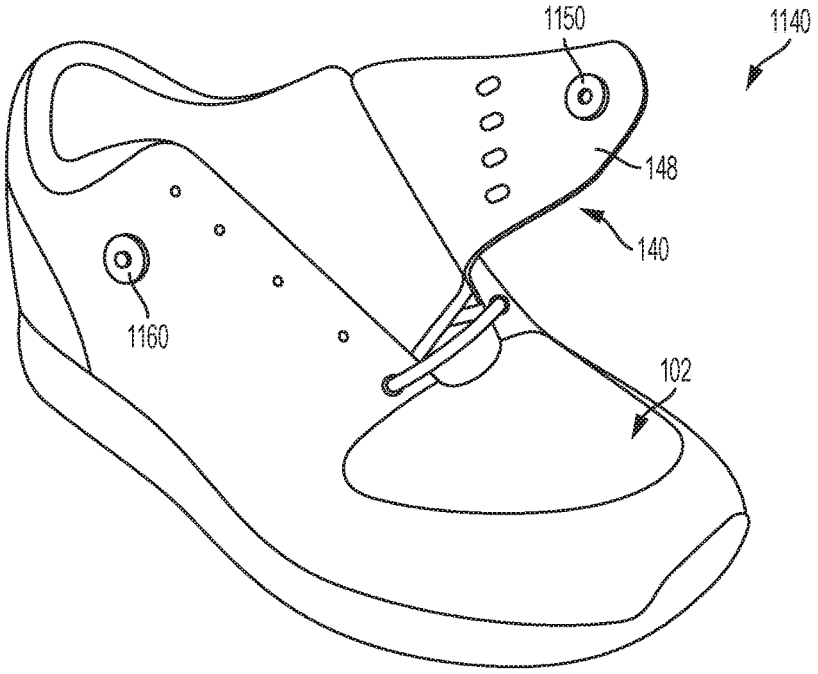
FIG. 11 is a schematic isometric view of an embodiment of a clasp element.

For purposes of illustration, a few examples of possible clasp mechanisms are described here. Referring to FIGS. 9-11, it may be seen that in some embodiments the clasp element may comprise a magnetic fastener or magnetic contact system. Specifically referring to FIG. 9, in one embodiment, there may be a first clasp element 940 that includes a first portion 950 and a second portion 960. When first clasp element 940 is in the closed configuration, the magnetic fastener portions (here first portion 950 and second portion 960) are held together securely by an attractive force, allowing for a magnetic closure force. In some cases, the magnetic closure is supplemented by a type of mechanical locking, which securely fixes first clasp element 940 in the closed configuration.

In one embodiment, a user may close or lock first clasp element 940 by bringing first portion 950 and second portion 960 toward one another, for example, by bringing flap portion 148 toward the lateral side of upper 102. Once the attractive magnetic materials disposed in the two portions contact one another, a mechanical locking mechanism may further secure them together.

Furthermore, in order to increase the security of first clasp element 940, the opening procedure may differ from the closing procedure. In one embodiment, to pull open or detach moveable assembly 140 from upper 102, the mechanism may be circumferentially actuated. In other words, in some embodiments, a person may rotate or twist first clasp element 940 (while holding or maintaining the rest of article 100 steady). This can turn or adjust a part of first portion 950 and change the circumferential position of first portion 950 relative to second portion 960. This turning may act to change the polarity within first clasp element 940 in some cases. In other words, the circumferential actuation can allow a displacement of the magnetic material in first clasp element 940, and thereby reverse the polarity of the magnetic materials disposed within. In some embodiments, the force can reverse the position of the magnets disposed within first clasp element 940 such that they repel each other, which supports the opening procedure. This may allow for simple operation with just one hand.

Similarly, referring to FIG. 10, in another embodiment, there may be a second clasp element 1040 that comprises a first portion 1050 and a second portion 1060. When second clasp element 1040 is in the closed configuration, the magnetic fastener portions (here first portion 1050 and second portion 1060) are held together securely by an attractive force, allowing for a magnetic closure force. In some cases, the magnetic closure is supplemented by a type of mechanical locking, which securely fixes second clasp element 1040 in the closed configuration.

In one embodiment, a user may close or lock second clasp element 1040 by bringing first portion 1050 and second portion 1060 toward one another, for example, by bringing flap portion 148 toward the lateral side of upper 102. Once the attractive magnetic materials disposed in the two portions contact one another, a mechanical locking mechanism may further secure them together.

Furthermore, in order to increase the security of second clasp element 1040, the opening procedure may differ from the closing procedure. As noted above, in some embodiments, a clasp element may be joined to pull tab 310. In one embodiment, pull tab 310 can be formed from an elongated piece of material such as a tensile element, a loop, or a hook which extends from an end of second portion 1060 to a free end of pull tab 310. Pull tab 310 can be a slightly wider portion of material than second portion 1060, or it may comprise a lace-like loop. In one embodiment, pull tab 310 may be angled away from the elongated lateral edge 158 of moveable assembly 148 (see FIG. 5) to allow a user to more easily grasp pull tab 310 for manipulation, such as to separate flap portion 148 from upper 102. Thus, in some embodiments, to pull open or detach moveable assembly 140 from upper 102, the clasping mechanism may include a pulling loop or tab. In other words, in some embodiments, a person may unlock second clasp element 1040 by grasping and pulling on pull tab 310 (for example) which is joined to a portion of either first portion 1050 or second portion 1060.

In one embodiment, by pulling the tab, the mechanism may be radially actuated. In other words, this pulling force can reorient a portion of second clasp element 1040, which may act to change the polarity within second clasp element 1040. In some embodiments, the pulling force can allow a radial displacement of the magnetic material in second clasp element 1040, thereby reversing the polarity of the magnets within. In some embodiments, this push or pulling force can then reverse the magnets disposed within second clasp element 1040 such that they repel each other, which supports the opening procedure. This may allow for simple operation with just one hand.

Furthermore, in another example, a more traditional magnetic closure device may be used, such as a magnetic catch, which comprises a third clasp element 1140 shown in FIG. 11. Third clasp element 1140 has a first portion 1150 associated with flap portion 148, and a second portion 1160 disposed along upper 102. In some embodiments, first portion 1150 includes a first magnetic material, and second portion 1160 includes a second magnetic material. When the two portions are brought closer together, the magnetic materials may attract and draw toward one another. In some embodiments, first portion 1150 and second portion 1160 can remain secured or connected together upon making contact. To open third clasp element 1140, a user can pull flap portion 148 away from upper 102 until the pulling force exceeds the attractive magnetic force between first portion 1150 and second portion 1160.

Figure 12:
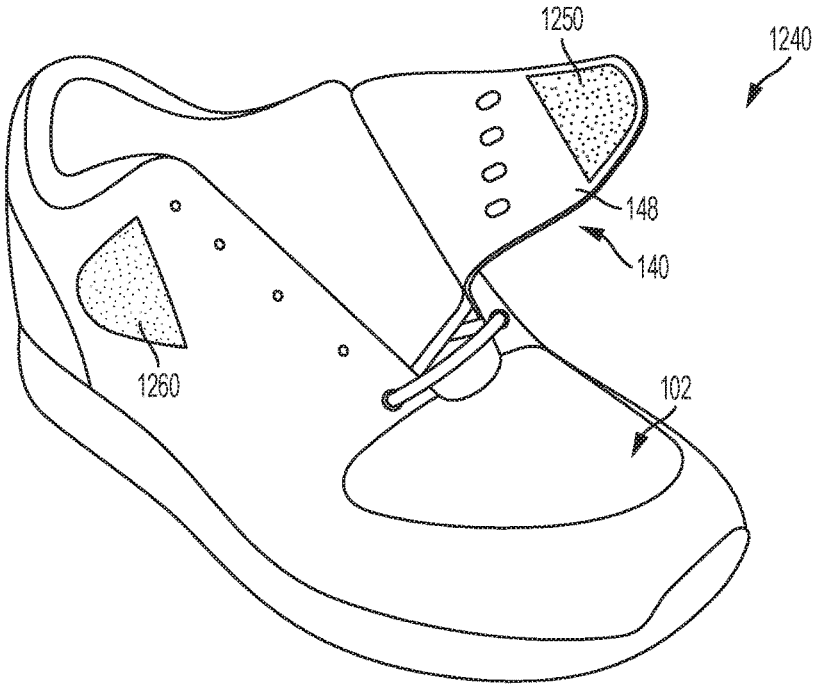
FIG. 12 is a schematic isometric view of an embodiment of a clasp element.

In another example, a hook and loop fastener such as Velcro may be utilized. As shown in FIG. 12, a fourth clasp element 1240 can comprise a first portion 1250 with a hook portion and a second portion 1260 with a loop portion. In other embodiments, first portion 1250 may have a loop portion and second portion 1260 may have a hook portion. A user may bring the two portions together, such that a bond is formed between the hook and loop materials. When the user exerts a pulling force greater than the force of the bond between the hook and the loop, moveable assembly 140 may be released and moved.

In other embodiments, a clasp element may include a first material along one side of the moveable assembly, and a second material along the upper. The first material and the second material can each be made of various materials, including Teflon loops, polyester hooks, Velcro, glass backing, and other touch fastener materials. Thus, any type of releasable clasp may be utilized by the embodiments disclosed herein.

In different embodiments, the fastening systems described herein may adjust or apply tension primarily through the tautness of moveable assembly 140 in its closed configuration. Thus, tongue portion 122, eyelet region 132, and tensile element 108 (see FIG. 1) can be generally aesthetic or serve to mask a primary feature of moveable assembly 140, which can be turned to provide a user with an easy entry or exit from interior cavity 106.

However, in other embodiments it should be understood that tensile element 108 may also provide functionality to article 100. In other words, though the tightening or closure of article 100 can generally occur as a result of contacting moveable assembly 140 with lateral side 16 of upper 102 as illustrated above, in other embodiments, additional or "fine" tension control may be possible through the adjustment of tensile element 108. For purposes of this disclosure, fine tension control refers to relatively smaller or more minute adjustments to the tension of article 100. For example, while the adjustment of moveable assembly 140 may provide a user with gross tension control in some embodiments, such that a foot may be moved in and out of article 100, users may find that they can adjust the tension further through the adjustment of tensile element 108 along throat portion 118.

Thus, in some embodiments, tensile element 108 may be engaged with throat portion 118 such that article 100 is provided with a more traditional lace system that functions to tighten article 100 about the foot of a wearer. The arrangement depicted herein would allow threading a lace (tensile element 108) in a zig-zag pattern through two parallel rows of eyelets that are placed on opposite sides of a tongue area (disposed along lateral portion 136 and medial portion 134, as shown in FIGS. 1 and 2). The article can then be tightened by pulling on opposite ends of the threaded lace to pull the two rows of eyelets together so that the closure edges are urged toward the middle of the foot, and then tying the lace ends in a knot to maintain the desired tension.

Furthermore, in some embodiments, a user may configure or rearrange portions of article 100 to be used primarily with one or more tensile elements. In some embodiments, article 100 may include provisions for switching between an easy entry shoe to a more traditional laced shoe. For example, referring to FIG. 8, a first set of eyelets ("first set") 800 and a second set of eyelets ("second set") 850 are identified. In one embodiment, first set 800 may be associated with or disposed adjacent to lateral instep edge 450 of upper 102 (see FIG. 4). In another embodiment, second set 850 may be associated with or disposed adjacent to lateral edge 158 of moveable assembly 140. In some embodiments, when moveable assembly 140 is disposed in the closed configuration, first set 800 and second set 850 may generally correspond or align with one another. In other words, one or more eyelets in first set 800 may line up with one or more eyelets in second set 850. Thus, in some embodiments, a user may configure a tensile element such that it extends from medial portion 134 of eyelet region 132 (see FIG. 1) and further engages with second set 850 and first set 800. In some cases, the tensile element can then be laced through both lateral side 16 of moveable assembly 140 as well as lateral side 16 of upper 102, forming a more secure fastening region. In some embodiments, this arrangement may attach lateral side 16 of moveable assembly 140 to upper 102, and inhibit moveable assembly 140 from shifting or being removed from lateral side 16 of upper 102. Thus, a tensile element may also be used to manipulate gross tension controls in some embodiments.

Figure 13:
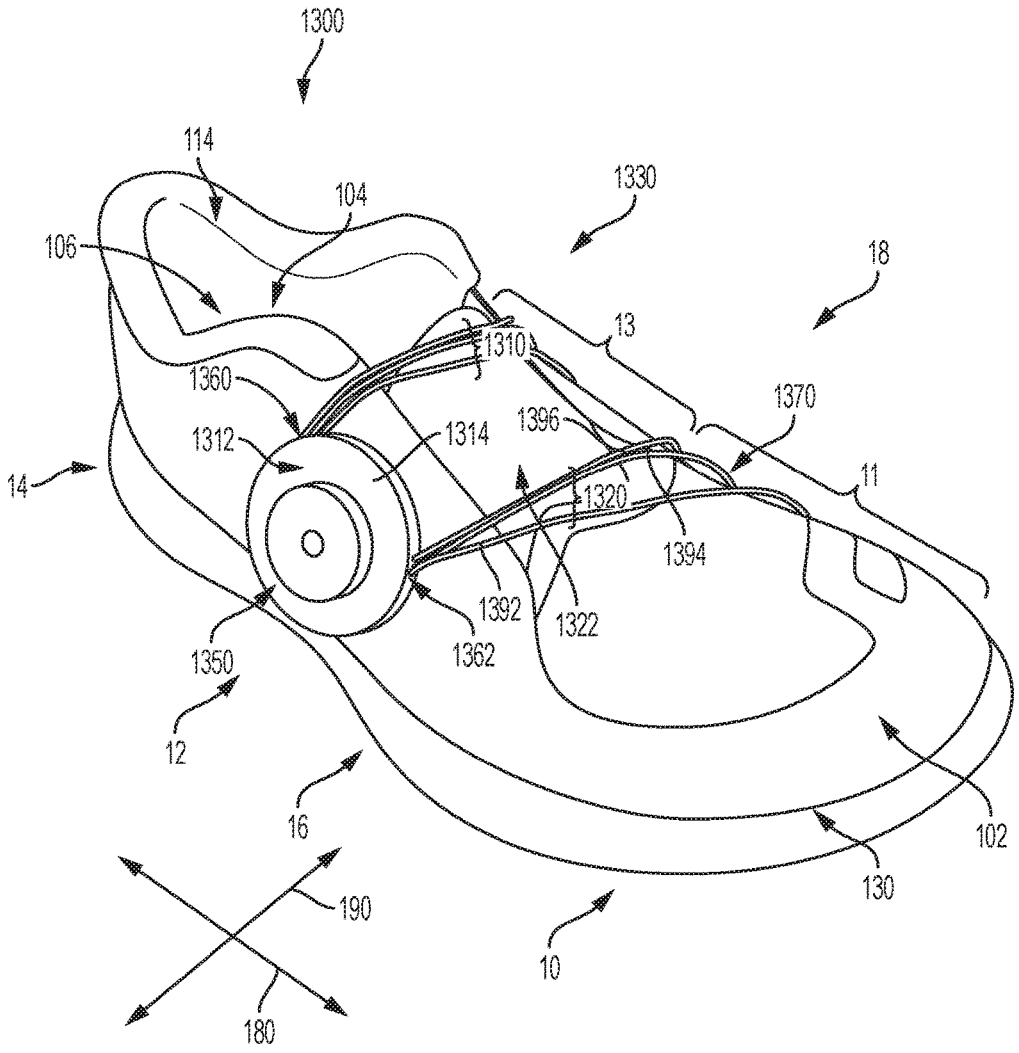
FIG. 13 is a schematic isometric view of an embodiment of an article of footwear including an upper and a tensioning device in a closed configuration.
Figure 14:
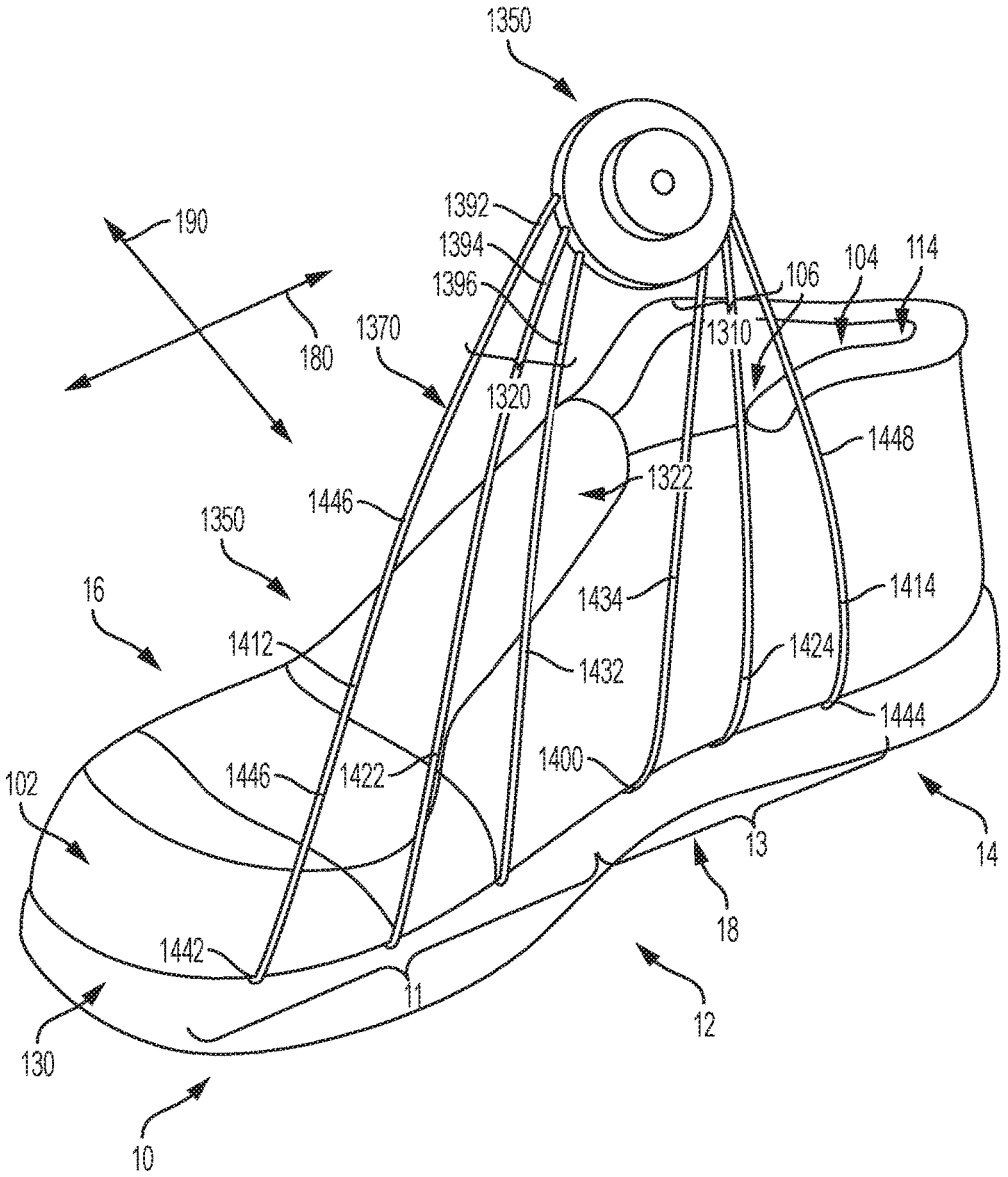
FIG. 14 is a schematic isometric view of an embodiment of an article of footwear including an upper and a tensioning device in an open configuration.
Figure 15:
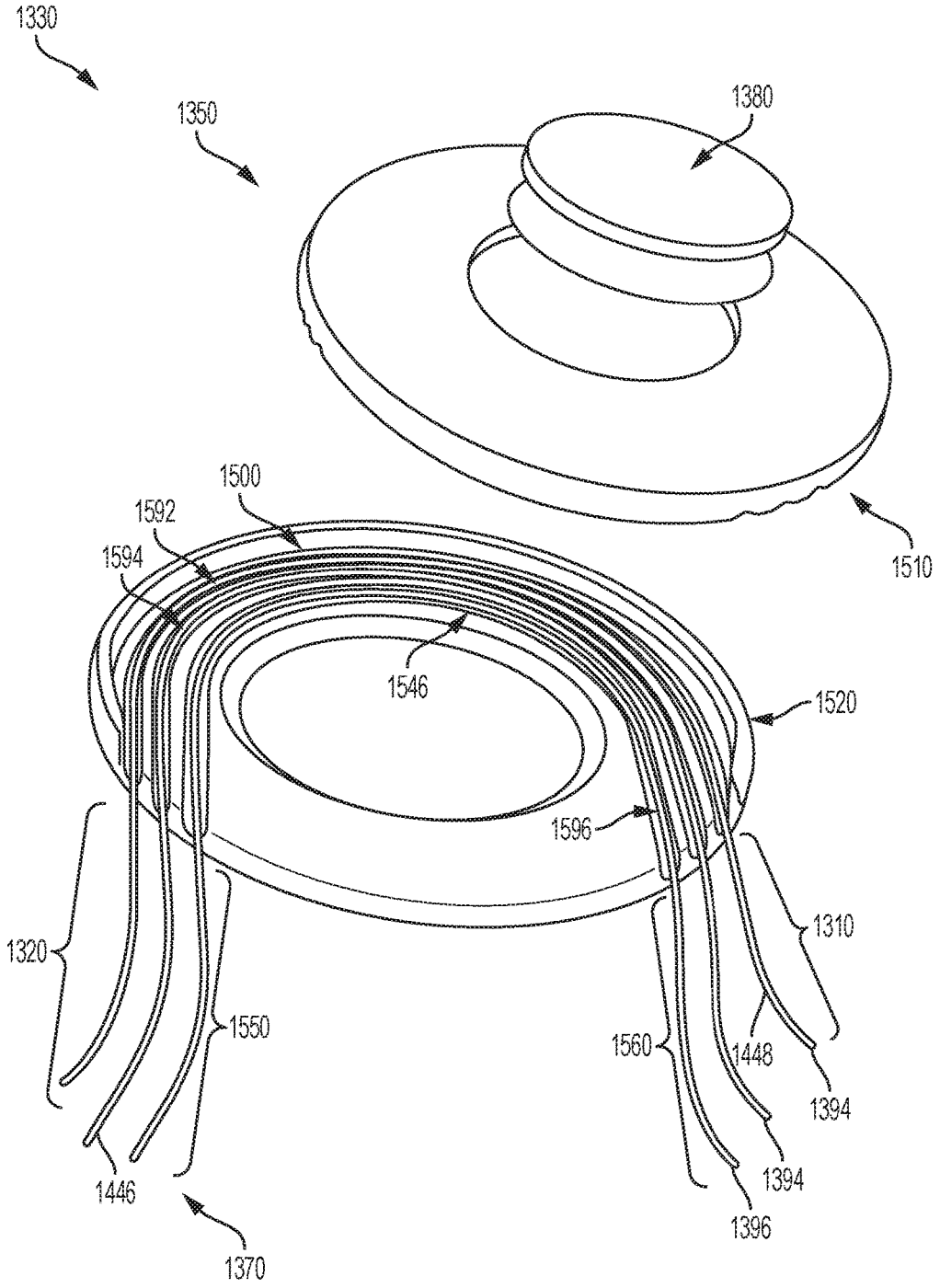
FIG. 15 is a schematic exploded view of an embodiment of a tensioning device.

In different embodiments, other types of tensioning devices may be utilized with an article to facilitate the use of the various fastening systems described above with respect to FIGS. 1-12. For example, multiple users with the same standard shoe size may have feet of different shapes, volumes, and/or physical characteristics. It may be desirable in some cases for an article of footwear to include provisions for accommodating varying foot shapes or various individual anatomical features. Referring to FIGS. 13-15, in some embodiments, a tensioning device 1350 may be used in conjunction with any of the clasp elements and fastening systems described herein. For purposes of this disclosure, a tensioning device refers to a device that allows a change in the level of tensioning of an article of footwear. In one embodiment, a tensioning device specifically facilitates an adjustment of the dispersion of volume of interior cavity 106 of the article of footwear. In other words, the volume of the interior cavity of the article in a first state can be arranged such that there is a first volume in the forefoot region and a second volume in the midfoot region. In a second state, as a wearer's foot shifts within the article, the forefoot region can have a third volume different from the first volume, and the midfoot region can have a fourth volume different from the second volume. Thus, the arrangement of the volume and/or the volume size of a region in the interior cavity can change. In some embodiments, the tensioning device may automatically or freely (e.g., without direct manipulation by a user) adjust the tensioning of the upper and allow the volume in a first region of a given space to increase while the volume in a second region of the same given space decreases in a generally corresponding manner.

Specifically referring to FIG. 13, a second article of footwear ("second article") 1300 is depicted with a second fastening system 1330. In different embodiments, second fastening system 1330 can include provisions for facilitating the insertion of a foot or removal of a foot from second article 1300. Furthermore, in some embodiments, second article 1300 can include provisions for helping to secure or fasten upper 102 and sole structure 130 to a foot. In different embodiments, second fastening system 1330 could incorporate various fastening provisions or tensioning devices including moveable regions, laces, tensile elements, clasps, buckles, straps, zippers, pulleys, or other kinds of devices that may help secure upper 102 around a foot. In the embodiment of FIGS. 13 and 14, second fastening system 1330 comprises tensioning device 1350 and cables 1370.

As shown in FIG. 13, cables 1370 extend across upper 102 from medial side 18 to lateral side 16. In some cases, cables 1370 extend in a direction generally aligned with lateral axis 190. Cables 370 can be attached, secured, or connected to a portion of second article 1300 in some embodiments. For example, as shown in the medial side view of second article 1300 provided in FIG. 14, each of the ends of cables 1370 are attached to second article 1300 by anchor portions 1400.

In various embodiments, anchor portions 1400 can comprise regions where a component or portion of cables 1370 are joined or otherwise secured. In one embodiment, anchor portions 1400 may be fixedly attached to one or more layers of upper 102. For purposes of this description, "fixedly attached" refers to an attachment between portions of two elements or materials where the portions are intended to remain attached during use of the article. In some cases, this may be referred to as permanently attached. Fixedly attached may be contrasted with surfaces that are adjustable or moveable, where components or materials are intended or readily capable of moving relative to one another. The fixed attachment may be formed through sewing, stitching, fusion, bonding, glue (by an adhesive or other agents), or a combination of thereof. In some cases, anchor portions can provides a high level of strength and stability. In FIG. 14, cables 1370 are anchored in a region extending between upper 102 and sole structure 130. In other embodiments, anchor portions 1400 may be directly attached to a portion of upper 102 or sole structure 130, including the underside sole structure 130. In addition, anchor portions may be used to position or direct a portion of cables 1370 along a specific orientation. For example, in FIGS. 13 and 14, anchor portions 1400 are arranged such that cables 1370 are oriented diagonally, extending from anchor portions 1400 at an angle toward tensioning device 1350 disposed along midfoot portion 12.

Thus, in one embodiment, cables 1370 extend from medial side 18 and loop around tensioning device 1350 that can be secured and/or disposed on lateral side 16. For example, as shown in FIG. 14, a first end 1442 of first cable 1392 is anchored to upper 102 in forefoot region 10 and extends along a forward portion 1446 of first cable 1392 toward tensioning device 1350. An intermediate portion (shown in FIG. 15 as intermediate portion 1546) is routed through the interior of tensioning device 1350, and then extends back toward medial side 18 along a rearward portion 1448 of first cable 1392 to a second end 1444, where second end 1444 is anchored to upper 102 in midfoot region 12. In the embodiment shown, forward portion 1446 is positioned nearer toward the toe region of article 1300 relative to rearward portion 1448. Similarly, rearward portion 1448 is disposed closer to heel region 14 relative to forward portion 1336. It should be understood that the regions identified as forward portion 1446, intermediate portion 1546, and rearward portion 1448 are for reference purposes only and are not intended to demarcate precise area of first cable 1392. Furthermore, the lengths and regions associated with forward portion 1446 of first cable 1392 and rearward portion 1448 of first cable 1392 may change as adjustments to the tensioning of second fastening system 1330 occur. In addition, the specific region of first cable 1392 routed through the interior of tensioning device 1350 (i.e., intermediate portion 1546) can also change as adjustments to the tensioning of second fastening system 1330 occur.

In other embodiments, cables 1370 may be arranged along other directions or orientations. Furthermore, in different embodiments, tensioning device 1350 may be disposed, releasably secured, fastening, and/or removably attached along any other portion of second article 1300. In some embodiments, for example, cables 1370 can extend from anchor portions on lateral side 16 toward medial side 18 and loop around or be otherwise secured by a tensioning device that is either disposed and/or secured on lateral side 16 or is detached and moved up or down.

In some embodiments, cables 1370 comprise one or more portions of a tensile or lacing element. For example, in FIG. 13, cables 1370 comprise a first cable 1392, a second cable 1394, and a third cable 1396. Furthermore, cables 1370 are include a forward cable portion set ("forward set") 1320 and a rearward cable portion set ("rearward set") 1310, where forward set 1320 includes the portions of first cable 1392, second cable 1394, and third cable 1396 that extend from medial side 18 into tensioning device 1350 and are arranged nearer forefoot region 10 (relative to rearward set 1310), while rearward set 1310 includes the portions of first cable 1392, second cable 1394, and third cable 1396 that extend from medial side 18 into tensioning device 1350 and are arranged nearer heel region 14 (relative to forward set 1320). In one embodiment, forward set 1320 includes portions of first cable 1392, second cable 1394, and third cable 1396 that begin and/or are attached to medial side 18 of second article 1300 in instep region 11, and rearward set 1310 includes portions of cables 1370 that begin and/or are attached to medial side 18 of second article 1300 in vamp region 13.

In some embodiments, cables 1370 may comprise a lacing or tensile element that may be routed around a portion of upper 102, as will be discussed below. For purposes of this disclosure, lacing or tensile elements may be formed from any generally one-dimensional material. As utilized with respect to the present invention, the term "one-dimensional material" or variants thereof is intended to encompass generally elongated materials exhibiting lengths that are substantially greater than their width and thickness. Accordingly, suitable materials for tensile elements include various filaments, fibers, yarns, threads, cables, laces (i.e., lacing elements), or ropes that are formed from rayon, nylon, polyester, polyacrylic, silk, cotton, carbon, glass, aramids (e.g., para-aramid fibers and meta-aramid fibers), ultra-high molecular weight polyethylene, liquid crystal polymer, copper, aluminum, and steel. Whereas filaments have an indefinite length and may be utilized individually as tensile elements, fibers have a relatively short length and generally go through spinning or twisting processes to produce a strand of suitable length. An individual filament utilized in the tensile element, guide elements, and/or reinforcing elements may be formed from a single material (i.e., a monocomponent filament) or from multiple materials (i.e., a bicomponent filament). Similarly, different filaments may be formed from different materials. As an example, yarns utilized as tensile elements may include filaments that are each formed from a common material, may include filaments that are each formed from two or more different materials, or may include filaments that are each formed from two or more different materials. Similar concepts also apply to threads, cables, or ropes. The thickness of tensile elements may also vary significantly to range from 0.03 millimeters to more than 15 millimeters, for example. Although one-dimensional materials will often have a cross section where width and thickness are substantially equal (e.g., a round or square cross section), some one-dimensional materials may have a width that is greater than a thickness (e.g., a rectangular, oval, or otherwise elongate cross section). Despite the greater width, a material may be considered one-dimensional if a length of the material is substantially greater than a width and a thickness of the material. In some embodiments, the tensile elements utilized with tensioning device 1350 can comprise materials, features, or elements disclosed in Dojan, U.S. Pat. No. 9,113,674, issued on Aug. 25, 2015 (previously U.S. patent application Ser. No. 13/327,229, filed Dec. 15, 2011) and entitled "Footwear Having An Upper With Forefoot Tensile Strand Elements," Dojan et al., U.S. Pat. No. 8,266,827, issued on Sep. 18, 2012 (previously U.S. patent application Ser. No. 12/546,022) and entitled "Article Of Footwear Incorporating Tensile Strands and Securing Strands," and Meschter, U.S. Pat. No. 7,574,818, issued on Aug. 18, 2009 (previously U.S. patent application Ser. No. 11/442,669, filed on May 25, 2006) and entitled "Article Of Footwear Having An Upper With Thread Structural Elements," the disclosures of which are incorporated herein by reference in their entirety.

In different embodiments, second fastening system 1330 can include provisions for adjusting the lengths of forward set 1320 relative to rearward set 1310. For example, in some embodiments, tensioning device 1350 comprises a pulley component. In some embodiments, the pulley component can include a grooved or recessed element, wheel, or other type of component with a substantially smooth interface for securing, receiving, guiding, moving, and/or routing cables 1370. Furthermore, in some embodiments, tensioning device 1350 may be configured to be attached and detached, or secured and released, from second article 1300. As noted above, tensioning device 1350 may be used in conjunction with any of the various clasp elements and fastening systems described herein. In other words, in different embodiments, tensioning device 1350 may be attached or secured to a clasp element such as clasp element 340 (see FIG. 3), second clasp element 1040 (see FIG. 10), third clasp element 1140 (see FIG. 11), fourth clasp element 1240 (see FIG. 12), and/or other clasp elements.

In some embodiments, a portion of tensioning device 1350 may be attached to a clasp element, where the clasp element operates as described above in FIGS. 1-12. In other words, tensioning device 1350 can be disposed adjacent to a clasp element in a manner similar to that described with respect to moveable assembly 140. For example, a portion of a base portion 1314 (i.e., the lower surface side) of tensioning device 1350 can be joined to a clasp element, similar to the attachment of third surface 370 of moveable assembly 140 (see FIG. 3) to a clasp element.

Thus, as shown in FIGS. 13 and 14, tensioning device 1350 can be removably or separably attached to upper 102 in some embodiments and allow second article 1300 to be readily adjusted. Furthermore, in one embodiment, second fastening system 1330 comprising cables 1370 and tensioning device 1350 may be rotated, pivoted, swiveled, swung, or otherwise moved back and forth along the region of second article 1300 associated with anchor portions 1400. In another embodiment, second fastening system 1330 may be turned in a manner similar to a page that is bound to the spine of a book. The degree of rotation about anchor portions 1400 permitted to second fastening system 1330 may vary in different embodiments. In some cases, second fastening system 1330 may be configured for rotation of over 180 degrees. In other cases, rotation may be limited to less than 180 degrees, or be substantially close to 90 degrees.

In some embodiments, second fastening system 1330 may be pulled away from upper 102, as shown in FIG. 14, and second article 1300 can be adjusted to vary the size of opening 104. In one embodiment, second fastening system 1330 as described herein may be utilized to adjust opening 104 to facilitate entry or exit of a foot, for example. While FIG. 13 shows second article 1300 with upper 102 in a closed configuration, FIG. 14 shows article 100 with upper 102 in an at least partially open configuration. Second fastening system 1330 may be used as an alternative to a conventional lacing system in some embodiments, or as a supplemental tensioning system. Furthermore, in some embodiments, second fastening system 1330 can be used in conjunction with the components of first fastening system 120, such as moveable assembly 140 (see FIGS. 1-6).

In one embodiment, second article 1300 can quickly transition between an open configuration (shown in FIG. 13) and a closed configuration (shown in FIG. 14). In the open or secured configuration, second fastening system 1330 and/or upper 102 is loosened, and various components are free to move in different directions. In one embodiment, upper 102 may be in the open state when tensioning device 1350 is loosened or detached from lateral side 16 of second article 1300. Furthermore, as described earlier, a throat opening of an article may be accessible in the open configuration. Thus, a tongue 1322 may be readily moved to form a throat opening and facilitate insertion of a foot in the open state. In one embodiment, upper 102 has opening 104 providing access to interior cavity 106, where opening 104 includes mouth 114 in the closed configuration, and where opening 104 includes both mouth 114 and a throat opening in the open configuration (where the throat opening extends through vamp region 13, as described above with respect to FIGS. 1-6).

In the closed configuration or secured state of second article 1300, second fastening system 1330 is tightened and/or providing tension, and tensioning device 1350 is attached to lateral side 16 of second article 1300. In one embodiment, second fastening system 1330 may exert a compressive force along at least a portion of instep region 13 and/or vamp region 11 in the closed configuration. In some embodiments, a user may attach tensioning device 1350 to upper 102 to secure a foot in second article 1300, and transition second article 1300 from the open state to the secured state. In addition, in some embodiments, a user may transition second article 1300 from the secured state to the open state by detaching tensioning device 1350 from upper 102 of second article 1300.

As noted above, second fastening system 1330 can include provisions for adjusting the lengths of forward set 1320 relative to rearward set 1310 through the use of tensioning device 1350. An exploded view of a front portion 1510 and a rear portion 1520 of tensioning device 1350 is depicted in FIG. 15, providing a view of the interior of tensioning device 1350. In FIG. 15, it can be seen that tensioning device 1350 can include a plurality of channels 1500 that extend in a semi-circular or semi-elliptical shape around a center region 1570. The channels can be comprised of grooves formed along one or both of front portion 1510 and rear portion 1520. For example, bottom portion 1520 includes a first channel portion 1592, a second channel portion 1594, and a third channel portion 1596. In some embodiments, cables 1370 may be looped or routed through each of channels 1500 that are formed in tensioning device 1350. In some embodiments, there may be a substantially similar set of channel portions in front portion 1510 that align with the channel portions of bottom portion 1520, together forming the channels that receive and route cables. This configuration may permit the cables to move freely (sliding back and forth along the grooves or channels of the pulley) and to facilitate the adjustment of the lengths of different parts of the cables. In different embodiments, channels 1500 can be formed to have a thickness or receiving volume configured to secure each of cables 1370 while also allowing cables 1370 to freely glide through tensioning device 1350.

Specifically, in the embodiment of FIG. 15, an intermediate portion of first cable 1392 is routed through first channel portion 1592, an intermediate portion of second cable 1394 is routed through second channel portion 1594, and an intermediate portion of third cable 1396 is routed through third channel portion 1596. Each channel can be dimensioned and sized to receive and route the desired cables used in the article of footwear.

In addition, in some embodiments, depending on the arrangement of cables 1370 through channels 1500, the overall length of each cable can vary. In one embodiment, first cable 1392 has a first length that is greater than a second length of second cable 1394, and the second length of second cable 1394 is greater than a third length of third cable 1396.

Furthermore, as a user inserts a foot into the article of footwear, fastening system 1330 can respond to differently shaped (i.e., volume) feet by adjusting the length between the forward portions of cables 1370 arranged toward the front and/or closer to the vamp region of the article of footwear as well as the rear portion of cables 1370 arranged toward the rear and/or closer to the instep region. In some embodiments, the lengths of forward set 1320 and rearward set 1310 can automatically adjust to accommodate the wearer's particular anatomical features. In some cases, as a user's foot moves or leans in different directions, the volume associated with a given region in the interior cavity of an article of footwear can change. In one embodiment, tensioning device 1350 can accommodate changes in foot placement and shifts in volume by increasing the lengths of forward set 1320 and decreasing the lengths of rearward set 1310 by a corresponding amount. In another embodiment, tensioning device 1350 can accommodate changes in foot placement and shifts in volume by increasing the lengths of rearward set 1310 and decreasing the lengths of forward set 1320 by a corresponding amount. For example, in one embodiment, forward portion 1446 of first cable 1392 can have a first length in a first state (e.g., associated with a first level of tensioning), and forward portion 1446 can have a second length in a second state (e.g., associated with a second level of tensioning), where the first length differs from the second length. Similarly, in one embodiment, rearward portion 1448 of first cable 1392 has a third length in a first state (e.g., associated with a first level of tensioning), and rearward portion 1448 has a fourth length in a second state (e.g., associated with a second level of tensioning), where the first length differs from the second length. In some embodiments, when the first length decreases, the third length increases. In addition, in some embodiments, when the first length increases, the third length decreases. Similarly, in other embodiments, when the second length decreases, the fourth length increases, and when the second length increases, the fourth length decreases. These adjustments can also improve the overall comfort of the article of footwear for a user upon insertion of a foot into the article of footwear.

In other words, as a foot is inserted into the article of footwear that incorporates second fastening system 1330, the volume of the interior cavity of the article of footwear can be adjusted to provide a better fit to the foot. In some embodiments, second fastening system 1330 can help to distribute and balance the tension throughout cables 1370. In addition, in different embodiments, tensioning device 1350 may include a knob 1380 or other handle to allow an individual to readily grasp and move tensioning device 1350.

This description of features, systems, and components is not intended to be exhaustive and in other embodiments, article 100 may include other features, systems, and/or components. Moreover, in other embodiments, some of these features, systems, and/or components could be optional. As an example, some embodiments may not include a tensile element or instep portion.

While various embodiments have been described, the description is intended to be exemplary, rather than limiting, and it will be apparent to those of ordinary skill in the art that many more embodiments and implementations are possible that are within the scope of the embodiments. Although many possible combinations of features are shown in the accompanying figures and discussed in this detailed description, many other combinations of the disclosed features are possible. Any feature of any embodiment may be used in combination with or substituted for any other feature or element in any other embodiment unless specifically restricted. Therefore, it will be understood that any of the features shown and/or discussed in the present disclosure may be implemented together in any suitable combination. Accordingly, the embodiments are not to be restricted except in light of the attached claims and their equivalents. Also, various modifications and changes may be made within the scope of the attached claims.

What is claimed is:

1. An article of footwear, the article of footwear comprising:

an upper including a forefoot region, a midfoot region, a medial side, and a lateral side;

the upper including a closed configuration and an open configuration;

the upper comprising a fastening system;

the fastening system comprising a tensioning device and a plurality of cables;

the tensioning device being releasably secured to a lateral side of the upper by a clasp element;

the plurality of cables including a first cable, the first cable including a first end, a second end, a forward portion, a rearward portion, and an intermediate portion;

the first end of the first cable being attached to a medial side of the upper in the forefoot region, the second end of the first cable being attached to the medial side of the upper in the midfoot region, the intermediate portion extending through an interior of the tensioning device; and wherein the forward portion of the first cable extends between the first end of the first cable to the tensioning device, wherein the rearward portion of the first cable extends between the second end of the first cable to the tensioning device.

2. The article of footwear according to claim 1, wherein the clasp element includes a first portion and a second portion, wherein the first portion of the clasp element is disposed along a bottom portion of the tensioning device, wherein the second portion of the clasp element is disposed along the upper, and wherein the fastening system is in the closed configuration when the first portion is engaged with the second portion.

3. The article of footwear according to claim 1, wherein the forward portion has a first length in a first state, wherein the forward portion has a second length in a second state, and wherein the first length differs from the second length.

4. The article of footwear according to claim 3, wherein the rearward portion has a third length in a first state, wherein the rearward portion has a fourth length in a second state, and wherein the third length differs from the fourth length.

5. The article of footwear according to claim 1, wherein the plurality of cables exert a compressive force along at least a part of an instep region of the upper when the upper is in the closed configuration.

6. The article of footwear according to claim 1, wherein each of the ends of the plurality of cables are attached to the medial side by anchor portions.

7. The article of footwear according to claim 1, wherein the forward portion extends across the forefoot region of the upper in the closed configuration and the rearward portion extends across the midfoot region of the upper in the closed configuration.

8. The article of footwear according to claim 5, wherein the upper further includes an opening providing access to an interior cavity of the upper, and wherein a first size of the opening in the closed configuration is different from a second size of the opening in the open configuration.

9. The article of footwear according to claim 2, wherein the fastening system is in the open configuration when the first portion is disengaged from the second portion.

10. The article of footwear according to claim 8, wherein the opening is configured to extend between the heel region and a vamp region of the upper in the open configuration.

11. The article of footwear according to claim 2, wherein the clasp element includes a magnetic material.

12. The article of footwear according to claim 2, wherein the clasp element is attached to a pull tab.

13. The article of footwear according to claim 1, wherein the plurality of cables comprises the first cable, a second cable, and a third cable, and wherein a first length of the first cable is greater than a second length of the second cable, and wherein the second length of the second cable is greater than a third length of the third cable.

14. The article of footwear according to claim 1, wherein the tensioning device includes a plurality of channels configured to receive and route the plurality of cables.

15. The article of footwear according to claim 13, wherein the tensioning device includes a first channel portion, a second channel portion, and a third channel portion, and wherein a portion of the first cable is routed through the first channel portion, a portion of the second cable is routed through the second channel portion, and a portion of the third cable is routed through the third channel portion.

16. The article of footwear according to claim 15, wherein the plurality of cables are configured to slide freely through the plurality of channels.

17. The article of footwear according to claim 1, wherein the length of the forward portion increases when the length of the rearward portion decreases.

18. The article of footwear according to claim 1, wherein the length of the rearward portion increases when the length of the forward portion decreases.

* * * * *